US005775046A

United States Patent [19]

Fanger et al.

[11] Patent Number: 5,775,046

[45] Date of Patent: Jul. 7, 1998

[54] MODULAR CONSTRUCTION MEMBER

[75] Inventors: David J. Fanger, Albuquerque, N. Mex.; Richard E. Seubert, Renton, Wash.; Byungho Han, San Jose, Calif.; Darcy M. Ytterdahl, Chicago, Ill.; O. John Bourg, III, Houma, La.

[73] Assignee: Massachusetts Institute of Technology, Cambridge, Mass.

[21] Appl. No.: 644,541

[22] Filed: May 10, 1996

[51] Int. Cl.[6] ..... E04B 2/08; E04B 2/18; E04B 2/32; E04B 2/46

[52] U.S. Cl. ..... 52/590.1; 52/586.2; 52/590.2; 52/591.2; 52/591.3; 52/592.1; 52/592.6; 312/107; 312/111; 312/112; 312/108; 108/158.12; 108/64; 108/157.18; 108/157.16; 446/127

[58] Field of Search ..... 52/586.2, 590.1, 52/590.2, 591.2, 591.3, 591.4, 592.1, 592.2, 592.6; 312/107, 111, 112, 108, 10; 40/358; 108/64, 158.12, 157.18, 157.16; 446/125, 127

[56] References Cited

U.S. PATENT DOCUMENTS

| | | | |
|---|---|---|---|
| D. 334,704 | 4/1993 | Andrews, Jr. et al. | D8/395 |
| D. 337,653 | 7/1993 | Hassel et al. | D3/35 |
| 3,468,081 | 9/1969 | Saarinen | 52/571.2 X |
| 3,668,832 | 6/1972 | Harman | 52/591.2 |
| 3,836,217 | 9/1974 | Shiina | 312/107 |
| 4,003,172 | 1/1977 | Pawl | 52/590.1 X |
| 4,095,769 | 6/1978 | Fengels | 108/64 X |
| 4,243,279 | 1/1981 | Ackeret | 312/107 |
| 4,413,867 | 11/1983 | Mosebrook et al. | 312/111 |
| 4,423,913 | 1/1984 | Lee | 312/107 |
| 4,577,914 | 3/1986 | Stravitz | 312/10 |
| 4,768,298 | 9/1988 | Polhemus et al. | 40/358 |
| 4,867,513 | 9/1989 | Choi | 312/108 X |
| 5,046,789 | 9/1991 | Lee | 312/108 |
| 5,267,863 | 12/1993 | Simmons, Jr. | 446/127 X |

OTHER PUBLICATIONS

Internet web page for Charles Water, at http://www.marshall.com/pub/cwx/static/ pganti.htm (date uncertain but before May 1, 1996).

Internet web page for Score Aerobic Floor & Mats, http://www.capecod.net/linray/Floor.htm (date uncertain but before May 1, 1996).

*Primary Examiner*—Carl D. Friedman
*Assistant Examiner*—W. Glenn Edwards
*Attorney, Agent, or Firm*—Steven J. Weissburg

[57] ABSTRACT

Construction member panels have an array of engaging elements and cooperating receiving spaces, such as dovetails and dovetail shaped keyways. The engaging elements are relatively closely spaced such that a pair of such panels can be meshed together, and will be locked against motion in two directions. The construction member panels can be used alone, with one planar member being fixed to a support and the other to an item to be supported, or they can be connected to each other to form units, such as L-shaped units, U-shaped units, or rectangular parallelepiped boxes. Shapes other than dovetails can also be used.

Specially located engaging elements along the length of construction members, or the sides of the units made therefrom allow mated construction members to be translated relative to each other as desired, even if one construction member is mated with and bridges across two facing construction members, thus exhibiting translational symmetry. The special locations and shapes of engaging elements at the ends of the construction members also facilitates the rotation in place of any units made from a plurality of construction members, thus exhibiting rotational symmetry. Typically, all or a portion of an engaging element at one end of a construction member is removed, while the location of the full engaging element at the other end, is specially controlled.

61 Claims, 22 Drawing Sheets

MODULAR CONSTRUCTION MEMBER

BACKGROUND

This invention relates in general to construction members, and more specifically, to construction members that can be used to form workspace organizing devices and display structures.

There are many different types of workspaces, including but not limited to: office desks, kitchen counters, workbenches, machine tool work areas, doctor's and dentist's operatories, home bathrooms, automobiles, school rooms, store checkout counters, etc. A common problem with each such workspace is how to organize items and how to store them so that horizontal surfaces remain uncluttered and free for the work at hand. At the same time, articles to be used must be available when needed.

Common solutions to these problems include drawers, permanent cubby holes, molded plastic desk organizers, pegboards, boxes on the floor, nearby shelves, loose trays, sets of nesting or interlocking boxes or trays, magnetic interconnects, etc. Each of these solutions satisfies some needs, and also has some drawbacks. Drawers are typically permanent and thus can not be located wherever the user desires. Peg boards provide only a relatively loose association between the support and the supported article, and thus the articles are easily jostled free. Loose trays on the horizontal surface are loose, will not stay in one place when desired, and also take up horizontal spaces. Shelving must be supported by a wall, or the work surface itself. Many types of interlocking trays or boxes can only be associated in one or two ways, requiring special attention and planning in set-up, and still resulting in limited flexibility. Many of the known solutions are relatively permanent, and are not easily changeable as the user's circumstances and needs change. Shelves are often difficult to install and rather unsteady. Magnetic devices are unsafe for use near computer storage media.

Another related area of need is to display various items. Retail sales displays are often based on shelves and vertical surfaces from which products, displays, advertisements and other items are supported. Plaques and other items are supported from vertical surfaces by nail-held hooks, adhesives, and hook-and-loop type cooperating separable fasteners, just to name a few. These systems also have drawbacks as discussed above. Further, adhesives can not be easily undone, and if so, either leave a mark, or are not sufficiently strong to hold the item in the first place. Hook-and-loop type fasteners are typically attached to the support surface and the supported item by adhesives. Further, both hook and loop items must be used, sometimes complicating the arrangement of the devices.

A common case of the display task, is to support an item, such as a plaque, a picture, or a shelf, from a vertical surface. A typical solution is to hang the item from a nail, hook or other fixture that is permanently fixed to a vertical position on the vertical support. A problem with this sort of support is that it is useful for only one vertical location. To move the picture downward, or to hang a smaller picture requires moving the support lower, thereby leaving a hole in the wall, or an empty, unused hook or fixture, which is typically not desired.

Another drawback of most of the known devices is that the organization system can not be easily expanded to include additional spaces, or spaces that can accommodate items of different sizes or shapes. Further, many types of solutions are suitable for organizing items on a horizontal surface upon which the organizing device sits, but are not suitable for organizing items on the underside of a horizontal surface (relative to a gravitational field) or on a vertical or inclined surface. Thus, the available space for supporting organizing structures is unduly limited. Moreover, many such known solutions are relatively unattractive aesthetically and are thus unsuitable for use in home or professional office spaces.

Accordingly, for the foregoing reasons, there is a need for an apparatus that can be added to any workspace that can be used to remove frequently needed items from the work surface, and to store them in a handy place that itself takes up only minimal valuable work surface area. A further need is for the storage apparatus to be flexible in its arrangement, to allow the user to customize the organization to immediate needs, and to change the organization easily as needs change. The need extends to apparatus that can be used to secure items to both vertical and horizontal surfaces; above and below. The apparatus should facilitate a sturdy structure that can securely support the weight of common objects used at desks, worktables, machine shops, etc. It is also desirable that the various components of the apparatus be shaped such that they can be connected together with minimal attention to their orientation and that the network can be extended as desired. The apparatus should be aesthetically attractive and relatively easy and economical to manufacture.

OBJECTS

Thus, the several objects of the invention include to provide an organization apparatus that can be added to any workspace to store frequently needed items handily, yet away from the work surface. Another object of the invention is to allow the user to organize the workspace in a manner that closely fits his/her needs, and that may be quickly and easily changed as the user's needs change. Still another object is to allow the user to use both upper and lower horizontal surfaces, as well as vertical surfaces as support surfaces for the organization apparatus, thereby making efficient use of all of the surfaces of the workspace. Another object is to provide a sturdy arrangement that will not collapse under the weight of the objects supported. It is also an object of the invention to allow the user to arrange various components of the apparatus with minimal attention to their orientation or location. Finally, it is an object of the invention to provide an aesthetic structure that can be used in professional office and home settings.

SUMMARY

To solve the desk and workspace organization problem, the apparatus of the invention uses construction member panels having an array of engaging elements and cooperating receiving spaces, such as dovetails and dovetail shaped keyways. The engaging elements are relatively closely spaced such that a pair of such panels can be meshed together, and will be locked against motion in two directions. The construction member panels can be used alone, with one planar member being fixed to a support and the other to an item to be supported, or they can be connected to each other to form units, such as L-shaped units, U-shaped units, or rectangular parallelepiped boxes. Shapes other than dovetails can also be used.

A preferred embodiment of the invention has specially located engaging elements along the length of the construction members, or the sides of the units made therefrom. The special locations allow mated construction members to be translated relative to each other as desired, even if one construction member is mated with and bridges across two facing construction members, thus exhibiting translational symmetry. The special locations and shapes of engaging elements at the ends of the construction members also facilitates the rotation in place of any units made from a plurality of construction members, thus exhibiting rotational symmetry.

A preferred embodiment of the invention is a construction member that extends along perpendicular discrete and sliding dimensions. It has engaging elements spaced apart along a discrete dimension. The engaging elements extend along a meshing dimension, that is perpendicular to both the discrete and sliding dimensions. They also typically, although not necessarily, are elongated along the sliding dimension. Each engaging element has a reference point, that is spaced an integral number of pitches from every other reference point. Typically, the reference points are spaced one pitch from each other, although this is not required. The reference points are also spaced an integral number of pitches from virtual corner lines that lie at either end of the construction member, along the discrete dimension. The virtual corner lines extend parallel to the sliding dimension.

The engaging elements define receiving spaces therebetween, which are shaped to accept the engaging elements of a similar construction member when the two construction members are slideably engaged with each other along the sliding dimension. The receiving spaces and engaging elements are mutually shaped and sized such that when slidingly mated together, the two construction members are restrained against motion in the meshing and the discrete dimensions. They can be substantially the same size and shape such as with conventional dovetails. If dovetails, the dovetails can be wide or narrow, and can have cantilevered ear portions (as defined below) that are isosceles or non-isosceles triangles. Rather than dovetails, other shapes can be used. The engaging elements need not be the same size and shape as the receiving spaces, but there should be a region, between a wide end registering plane and a narrow end registering plane of the engaging elements and the receiving spaces, that is essentially congruent and the same size. The narrow end registering plane is parallel to the sliding and discrete dimensions, and cuts through the narrowest part of the engaging elements. The wide end registering plane is parallel to the narrow end plane and cuts across the widest part of the engaging elements. A boundary plane is parallel to the sliding and discrete dimensions, and includes the virtual corner lines at both ends of the construction member along the discrete dimension, and all of the reference points of the engaging elements. The boundary plane bisects the region of the engaging elements and receiving spaces between the wide end and the narrow end registering planes. It also bisects the face between an engaging element and a receiving space.

Each construction member has a flush end and a butt end. At the flush end, a portion of the corner engaging element that is closest to the virtual corner line is removed. How much is removed depends on the size and shape of the engaging elements. The position of the engaging element closest to the virtual corner line is such that, if it were fully represented, its reference point would lie on the virtual corner line. For a dovetail having isosceles cantilevered ears, the entire ear portion near the virtual corner line is removed, on the flush end of the construction member.

Construction members as described can advantageously be combined with other construction members to form units, such as L-shaped, C-shaped or boxes. The angles between the members can be right angles, or any angle, typically between 45 and 150 degrees. The construction members are arranged with the butt end of one butted up against the flush end of another, such that the flush end is flush with the narrow end registering plane of the first. This arrangement allows either construction member of the pair to be mated with another construction member having engaging elements that will mate with it.

A preferred embodiment of the invention is a box that is formed from four construction members. The boxes, with the corner engaging elements of each being located and truncated as described, can be mated together to form a four box network, where any of the boxes can be removed and rotated and replaced. Further, any two of the boxes so mated can be removed together, translated along the two other boxes, and replaces, such that the corners do not coincide, thus providing translational symmetry.

Construction members of the invention can be provided in convenient places where organization is required, such as on the case of a computer monitor, in a kitchen under counters or shelves, on walls or sides of furniture, etc. Networks of units formed from the construction members can be formed for holding useful items at various workplaces.

Another preferred embodiment of the invention is an L-shaped or box or U-shaped unit as described above, that has been unitarily molded, rather than being formed from individual construction members.

Additional preferred embodimens are boxes that are shapes other than rectangles, such as hexagons, triangles and pentagons.

The invention is also useful in the design of floor coverings, such as tiles, and mats, by using the cross-sectional shape of rectangular parallelepipeds as the shape of the floor covering member.

BRIEF DESCRIPTION OF THE DRAWINGS

These and other features, aspects, and advantages of the present invention will become better understood with regard to the following description, appended claims and accompanying drawings, where:

DETAILED DESCRIPTION

Figure 1:
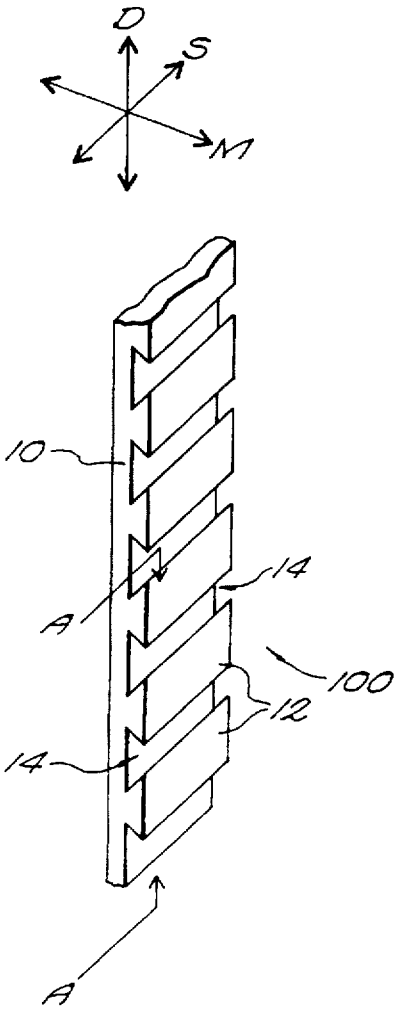
FIG. 1 is a perspective view of a preferred embodiment of a construction member of the invention, showing an arbitrary length along a discrete dimension.
Figure 1A:
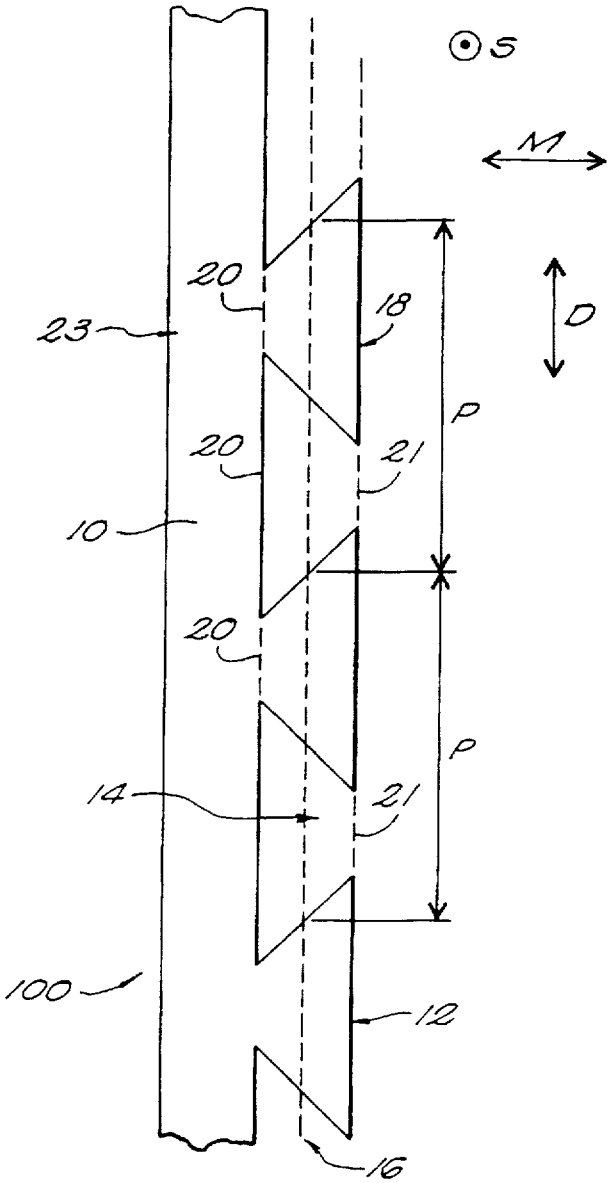
FIG. 1A is a cross-sectional view of the construction member of FIG. 1, along lines A—A.

A preferred embodiment of the present invention is a construction member 10, shown schematically in perspective in FIG. 1 and shown in partial cross-section in FIG. 1A, cut along the lines A—A of FIG. 1. The construction member 100 has a base section 10, having a plurality of male, key-like engaging elements 12 extending therefrom. In general, the key elements have a narrow region, which may be referred to herein and in the claims as a neck region, and a wider portion that may be referred to herein as the head region. The construction member 100 is generally planar, and can be characterized by a pair of orthogonal dimensions. A sliding dimension S extends into and out of the paper, as shown in FIG. 1A. A discrete dimension D extends up and down as shown in FIGS. 1 and 1A. It is also helpful to define the meshing dimension M, as perpendicular to both the sliding and discrete dimensions. The engaging elements 12 are spaced apart along the discrete dimension. The engaging elements, in one embodiment, are generally continuous and elongated in the sliding dimension. (In another embodiment, described below, they are discontinuous in this sliding dimension.) The lengths of the construction member in both the sliding and the discrete dimensions can be any length. In many instances, the length in both the discrete and the sliding dimension extend many times the width along the discrete dimension of one engaging element. However, these lengths can also be rather short, even to the point where the engaging elements are not considered to be elongated in the sliding dimension.

Between each pair of engaging elements is a female, keyway like receiving space 14. A boundary plane 16 (FIG. 1A) is parallel to both the discrete and sliding dimensions. The boundary plane 16 bisects that portion of the engaging elements 12, and the receiving spaces 14 therebetween, along the meshing dimension, that lies between a wide end registering plane 21 and a narrow end registering plane 20. This is also the region overwhich the engaging elements overlap and mesh. The registering planes 20 and 21 are parallel to the boundary plane 16. The wide end registering plane 21 is at the point along the meshing dimension where the engaging element is widest along the discrete dimension. Similarly, the narrow end registering plane 20 is at the location of the narrowest part of the engaging elements 12 along the discrete dimension D.

For an engaging element that is a more complex shape than a simple dovetail, the narrow end registering plane is defined as the plane that cuts through the narrowest part of an engaging element that would be adjacent an identical mated engaging element, if the mated engaging element were flipped 180° about an axis that is parallel to the discrete dimension. Similarly, the wide end registering plane is defined as the plane that cuts through the widest part of an engaging element that would be adjacent an identical mated engaging element, if the mated engaging element were flipped 180° about an axis that is parallel to the discrete dimension. In general the bisection of the region of overlap between two engaged identical engaging elements is the location of the boundary plane. This is generally the case in the various embodiments discussed below.

In the dovetail embodiment shown in FIG. 1A, the narrow end registering plane is also coplanar with the deepest portion of the receiving spaces 14 and the wide end registering plane 21 is coplanar with the bearing surface 18, at the tips of the engaging elements. This coincidence of the registering planes and the deepest portion and the bearing surface need not be the case, as is illustrated below, particularly with respect to the shapes of engaging elements shown in FIGS. 17, 21A, 21B and 21C.

Figure 13A:
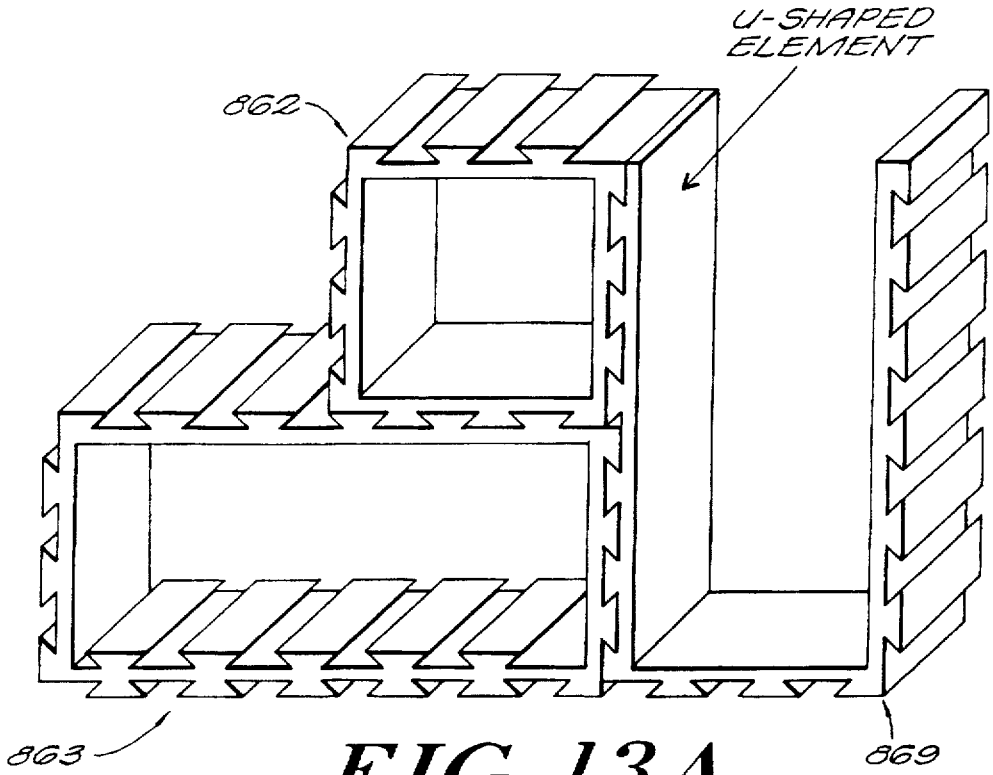
FIG. 13A shows schematically, in perspective view, a square box, a rectangular box (with engaging elements on both the outside and inside surfaces), and a U-shaped unit, made with the engaging elements located to provide both rotational and translational symmetries.

The surface 23 of the base 10 obverse the engaging elements 12 is shown as a smooth surface, although this side could also have engaging elements (as shown in FIG. 13A) or other surface details as desired. As shown in FIG. 1A, the engaging elements 12 can be in the shape of conventional dovetails, but other shapes are possible and are described below. The cross-sectional size and shape of the engaging elements 12 is such that each one has a portion that is wider in the discrete dimension than a portion that is closer to the base.

Figure 2:
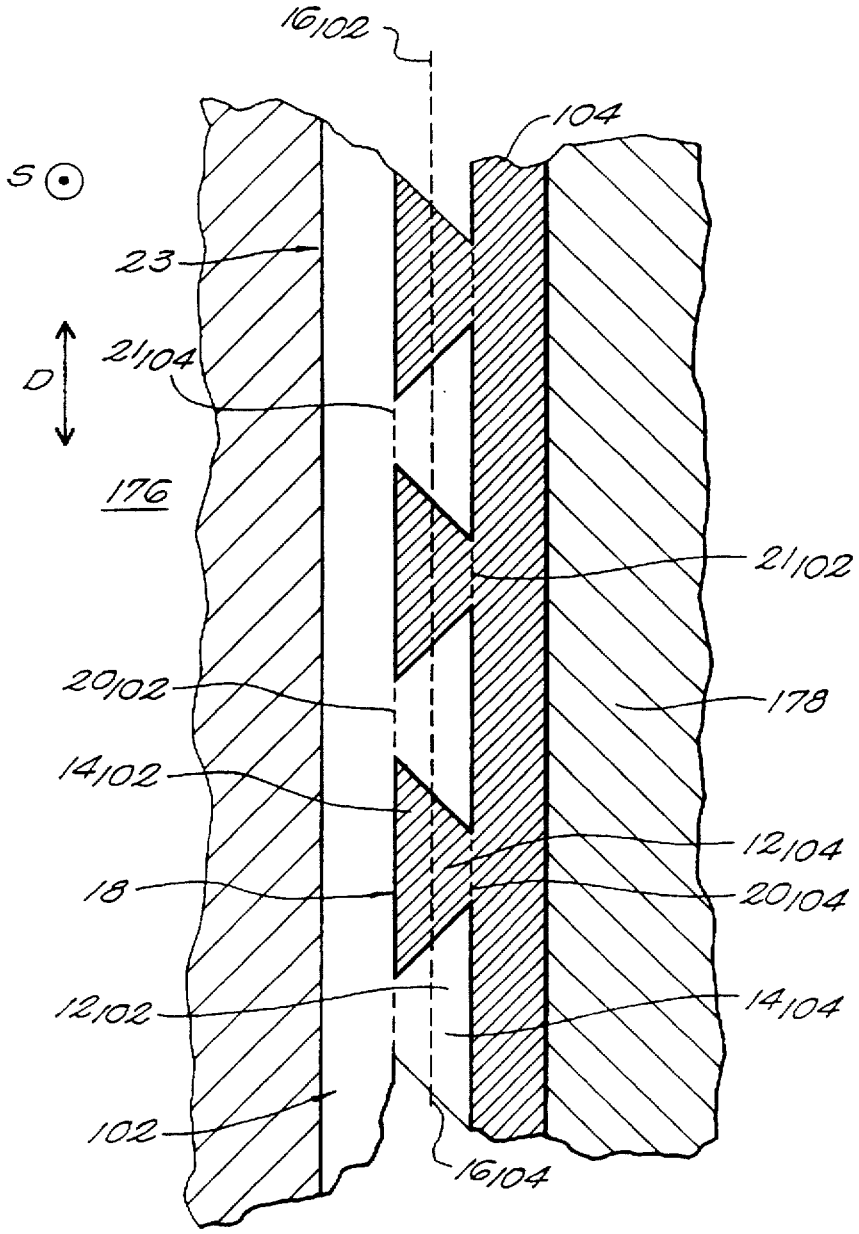
FIG. 2 is an end view of portions of a pair of construction members such as are shown in FIG. 1, meshed with each other by slidably engaging them along a slidable dimension.

As shown schematically in FIG. 2, the cross-sectional size and shape of the engaging elements 12 and the receiving spaces 14 is such that the engaging elements 12 of one construction member 102 can be slid along the continuous dimension into the receiving spaces 14 of another, similar construction member 104, and vice versa. It will be understood that, as shown in FIG. 2, an engaging element $\mathbf{12}_{102}$ of the construction member 102 is occupying the receiving space $\mathbf{14}_{104}$ of the construction member 104, while the engaging element $\mathbf{12}_{104}$ of the construction member 104 is occupying the receiving space $\mathbf{14}_{102}$ of the construction member 102. Once engaged, the sizes of the engaging elements 12 and the receiving spaces 14 are such that the two construction members 104 and 102 are substantially locked against relative motion along the discrete and meshing dimensions.

When the two construction members are so engaged, the boundary plane $\mathbf{16}_{102}$ of the construction member 102 substantially coincides with the boundary plane $\mathbf{16}_{104}$ of the construction member 104. Further, the narrow end registering plane of one construction member coincides with the wide end registering plane of the other construction member. Thus, the narrow end registering plane $\mathbf{20}_{102}$ of the construction member 102 coincides with the wide end registering plane $\mathbf{21}_{104}$ of the construction member 104 and vice versa. (The planes do not line up exactly, because some clearance must be provided to allow two engaging elements to be slideably engaged with each other. If all of the planes coincided exactly, there would be no clearance, an the parts could not engage. However, in the cases where the engaging elements of the two construction members are the same shape, the planes do substantially line up, and the designer of ordinary skill in the art will understand how to take the tolerances into account. There is an embodiment, discussed below, where the engaging elements need not be exactly the same shape on both construction members. In that case, the planes do not necessarily coincide at all.)

Thus the embodiment of the invention described above, with reference to FIGS. 1, 1A and 2 is useful for securing an object to a surface, where both the object and the surface carry a construction member 100 as described. This is shown schematically in FIG. 2. The construction member 102 is secured to a fixture 176, such as a wall. The construction member 104 is fixed to an object to be supported 178, such as a picture or a plaque.

For instance, in an office work cubicle, the vertical walls, or a region thereof can be provided with a construction member panel of engaging elements, with the sliding dimension S arranged horizontally. An object to be supported, such as a plaque, can be provided with a similar construction member, with the engaging elements sized and spaced so that they slidingly engage with the engaging elements and the receiving spaces of the wall mounted construction member. The plaque can be supported simply by engaging its construction member with the wall mounted construction member. The vertical location of the plaque can be adjusted simply by moving it along the discrete dimension relative to the wall mounted construction member. As long as there are enough engaging elements overlapping between the two construction members to provide the desired supporting strength, the plaque can be supported.

The area over which the wall mounted construction member extends is up to the designer or decorator. The entire vertical surface can be provided with such engaging elements. They can be any degree of fineness (along the discrete dimension) that economics and aesthetics desire. Engaging element widths of between 1 mm and 3 cm are typical, but not the limits. Rather than extending from floor to ceiling, the engaging elements may be confined to a specified region or vertical band. In office cubicles, the supporting engaging elements can be provided on office dividers, on the sides of desks, or on the sides of office equipment, such as computer monitors, file cabinets, etc.

Figure 4:
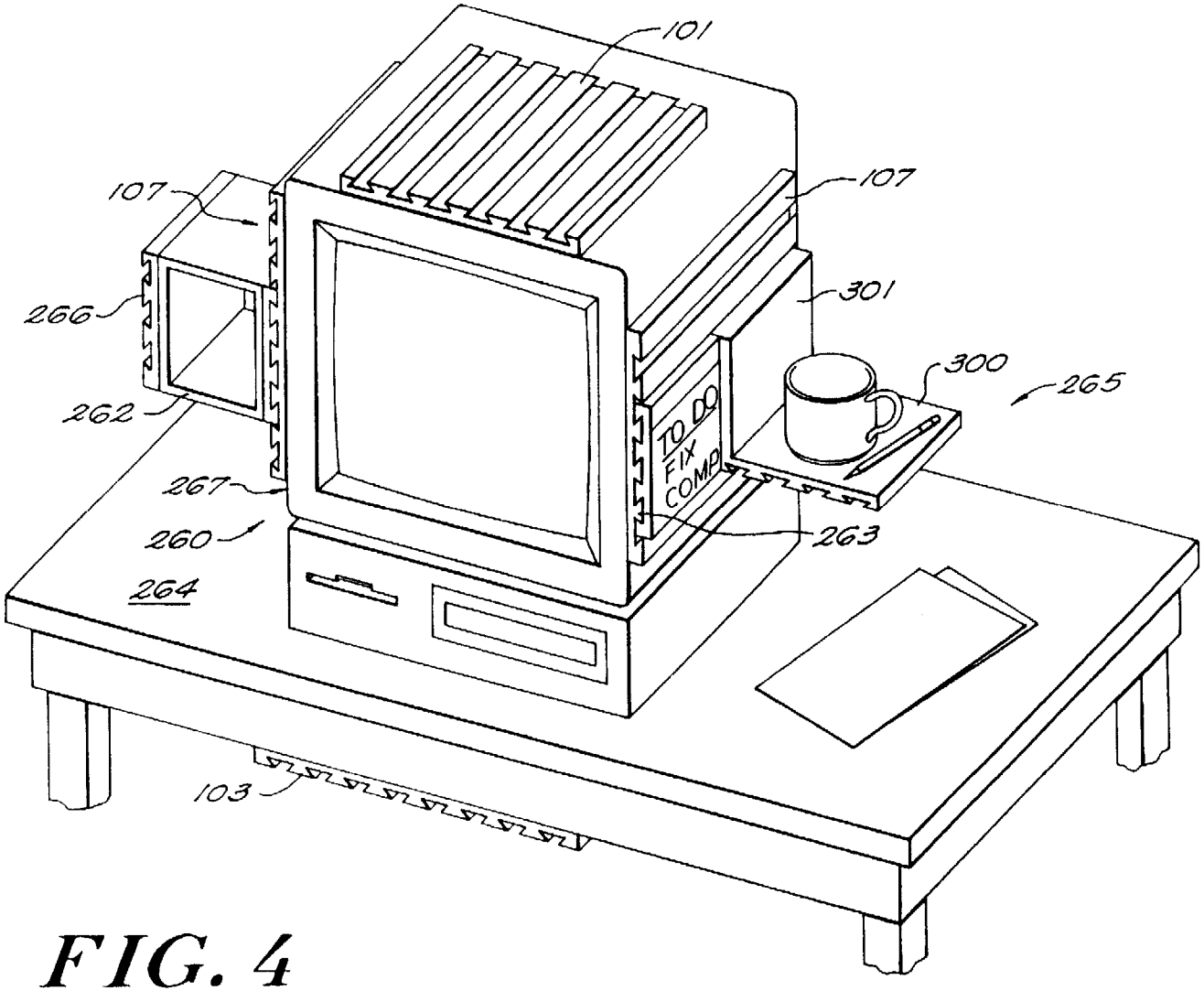
FIG. 4 is a schematic perspective view of numerous construction members such as are shown in FIG. 1, used as organizing structures at a computer workstation.

The computer monitor is ubiquitous in modern offices, and the space around it is typically open. A preferred embodiment of the invention is to provide a construction member on the vertical surface 267 of a computer monitor 260, as shown in FIG. 4. This construction member 107 can be used to support one or more panels 263, boxes 262, shelves 265, etc., if the box, shelf, etc. has a corresponding construction member on a corresponding surface. In FIG. 4, a note pad is shown fixed to the panel 263. A cup and pencil are shown resting on the shelf 265. The boxes can hold disks, pencils, paper clips, and other desk tools. Larger boxes for holding papers can also be provided. The box 262 is itself provided with a construction member 266 on its side opposite to that attached to the computer monitor 260. Another box, or a shelf, or a panel, or any article provided with a construction member can be attached to the box 262. The network can generally be extended significantly, depending on the organizational needs and aesthetic predilections of the user. In FIG. 4, the extent of the engaging elements and receiving spaces is exaggerated along the discrete dimension to facilitate illustration. Typically, this extent would be much shorter, providing a finer surface appearance.

Also, FIG. 4 shows the construction member extending from near the front of the monitor case to quite near to the back. This is possible in for many computer monitor cases (such as, for instance, the original Macintosh sold by Apple Computer of Cupertino, Calif., under the trade name SE. However, many other monitor cases have a two to four inch flat region near the front of the monitor, with a different, vented region closer to the back of the monitor. In such cases, it would be convenient to limit the rearward extent of the construction member to the non-vented region. Alternatively, the venting slats can be made into a construction member themselves, with the solid portions constituting the engaging elements and the open portions constituting the receiving spaces. However, it would be important to make sure that enough venting is provided even with the construction member engaged.

The construction member could, alternatively, be on a surface of any piece of computer or other office equipment.

The top surface of the monitor case can also be equipped with a construction member 101, and it can then be mated with corresponding construction members on other boxes, paper supports, etc.

The construction members can be molded directly into the monitor case, which is typically plastic. (In fact, many monitor and other computer components are already provided with a detailed surface, often comprised of parallel grooves.) Alternatively, the construction member can be secured to the monitor case by adhesives, or other suitable techniques known to the art.

Figure 5:
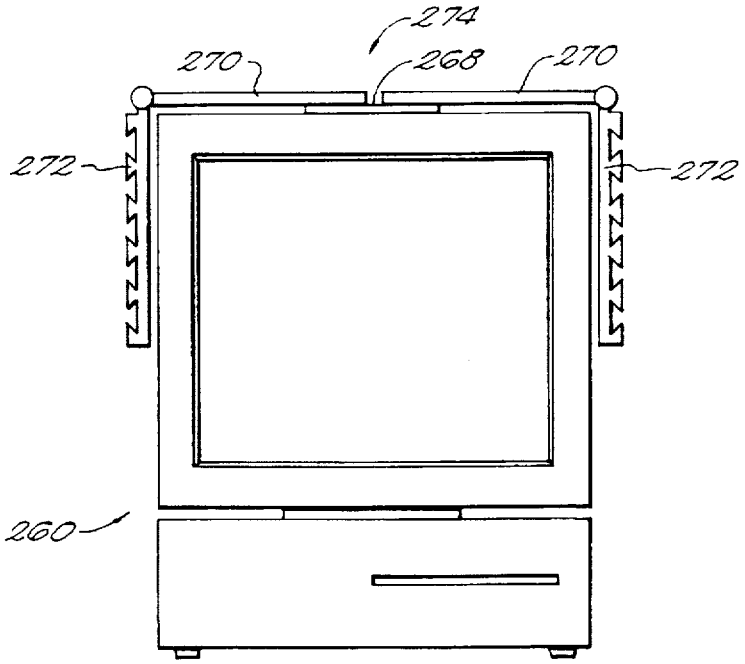
FIG. 5 is a schematic front view of an adjustable apparatus that incorporates one embodiment of the invention for use with different size computer monitors.

In one preferred embodiment shown schematically in FIG. 5, a telescoping apparatus 274 is provided that can accommodate any monitor within a range of widths. A foundation 268 is rested upon or secured to the monitor top by suitable means. Slidably mounted to the foundation is at least one extension 270, which carries at its end a construction member 272, which can either be permanently oriented at right angles to the foundation 268, or can be hingedly attached to the extension, to allow compact storage. The extension element 270 is sized so that it can be extended to allow the end construction member 272 to fit along the vertical side of the computer monitor case. These vertical construction elements 272 can be provided at both ends of the foundation element 268, which can be provided with one or two extension elements. The extension elements can be connected to the foundation using engaging elements and receiving spaces as described above, or by any other suitable slidable engagement mechanism.

In addition to vertical support surfaces, the embodiment shown in FIGS. 1, 1A and 2 can be used to support items from the underside of a horizontal surface. The underside of desks, tables, kitchen cabinets, etc. is provided with a construction element panel of engaging elements. Other objects have a mating construction element of engaging elements and can be supported from the horizontal surface. The supported items can include boxes, machines (such as in a kitchen, a toaster, a microwave oven, a can opener, etc.), racks (such as a spice or tool rack). A supporting construction member 103 is shown schematically attached to the underside of a desk 264 in FIG. 4. Items can be attached to this construction member as described above. Further, the underside of the shelf 265 is configured with a construction member to which another construction member can be attached.

It should also be noted that the construction member 100 presents a relatively flat surface, upon which items can be rested, virtually as if they were resting on a continuous surface. For instance, a coffee cup could be supported on the construction member 101 that is secured to the top of the monitor case. The spaces between the dovetail engaging elements can be made sufficiently small, so that the surface is essentially continuous relative to typical items to be supported thereon.

Another preferred embodiment has a box like shell having a construction element configuration on at least one of its outside surfaces, and an inside that has one of various different configurations. For instance, the inside of the box can include one or more drawers or a computer keyboard tray and slide. Thus, the construction element of a standard size can be provided on surfaces that are likely to be used as support surfaces, and manufacturers of items that are used in different settings can provide their devices with an outer surface that carries a mating construction element.

The embodiment shown in FIGS. 1, 1A, 2 and 4, generally discussed above, fulfills many of the goals of the invention. The connection between the supporting and supported panel elements can be quite strong, depending on the number of intermeshing engaging elements 12 and receiving spaces 14. The construction members are unobtrusive when not engaged, and can be made in attractive colors and outlines. A pair of intermeshing construction members can be easily engaged, simply by sliding them together. They are secure in this engagement, but can be disengaged easily. If it is desired to increase the engagement security, mating detents can be provided along the lengths of both pieces. Other similar structures can be used to secure the elements against relative motion along the sliding dimension, except with the application of a relatively large force. For instance, the surface texture can be roughened or smoothed to achieve the desired cohesiveness. The construction members can be changed quickly to accommodate changing needs of the user. They can be economically manufactured, by extrusion or cavity molding or by other known techniques. Each construction member itself is relatively strong, resisting flexing about an axis that is parallel to the discrete dimension.

Figure 3:
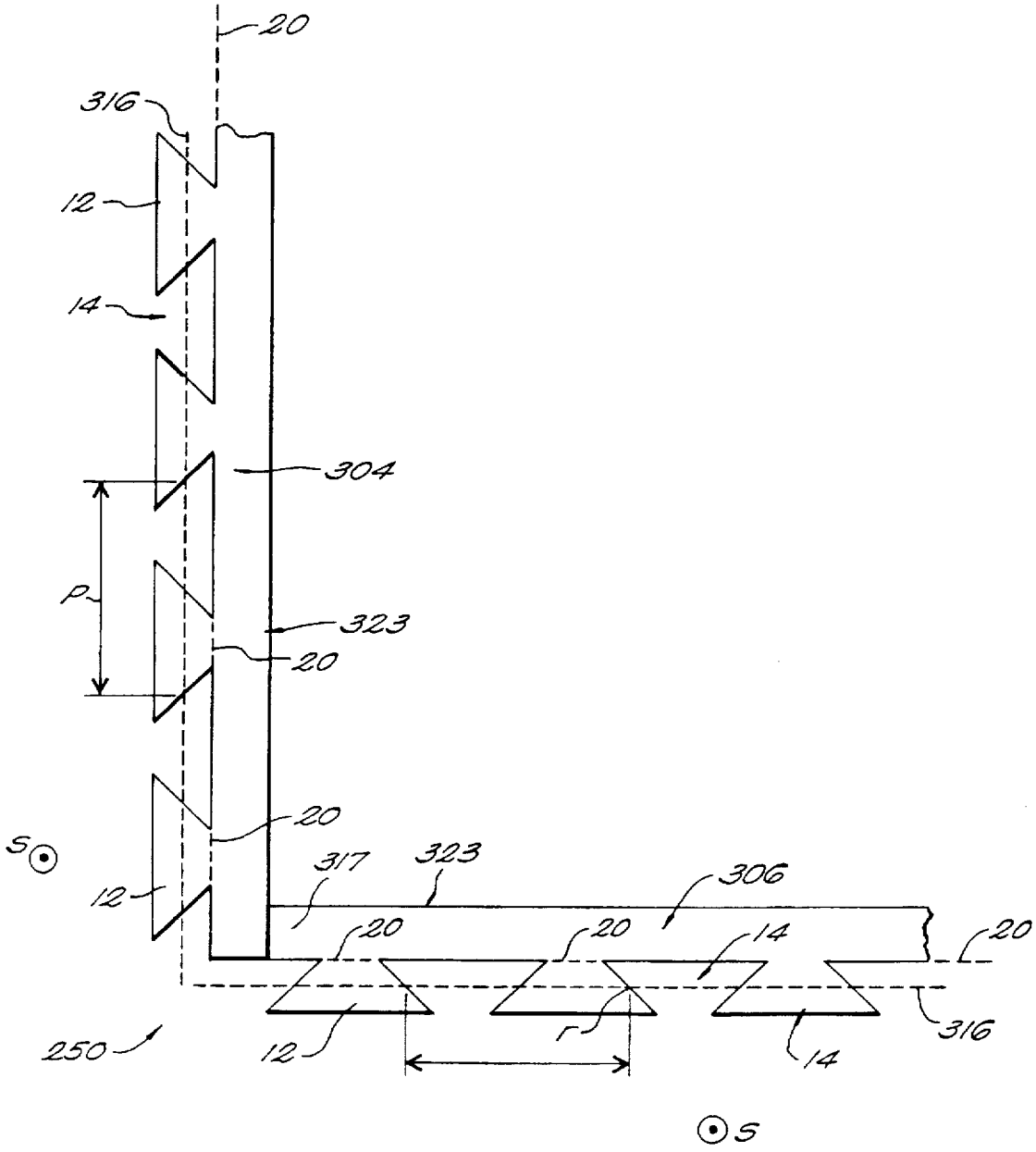
FIG. 3 is an end view of an L-shaped unit having two perpendicular sections, such as could be molded, or made from two construction members such as are shown in FIG. 1, connected to each other at right angles to form an L-shaped unit.

Two construction members 304 and 306 can be joined to each other, as shown in FIG. 3, with their boundary planes 316 perpendicular, and their sliding dimensions S parallel. The end 317 of one construction element, for instance 306, is butted up against the obverse surface 323 of the other construction element 304. This composite construction element may be referred to as an "L" or a right-angle shape. In this manner, a shelf 265 is formed that can be supported from a vertical surface, as shown in FIG. 4. Items can be placed on the shelf 265. Rather than a downward facing support surface, as shown in FIG. 4, the L-shape shown in FIG. 4 can be rotated clockwise 90°, such that the construction member 306, rather than the construction member 304, engages with the vertical construction member 107 and an upward facing set of engaging elements is provided. Another construction element can be slidingly engaged to this upward facing set, as described above.

For the basic embodiment of the invention under discussion, the requirements for the arrangement of the engaging elements relative to the corner of the L-shape are few. All that is required is that no portion of the engaging element 12 closest to the point where the construction members meet on either construction member 304 or 306, extend as far as the deepest region of the receiving spaces 14 of the other construction member. An equivalent requirement for the dovetail embodiment shown in FIG. 3, is that no portion of the engaging elements extend beyond the narrow end registering plane 20 of the other construction member. If a portion of an engaging element 12, such as its pointed ear portion, were to extend beyond the narrow end registering plane 20, then it would interfere with an engaging element of the support construction member. This requirement is modified a bit in connection with the engaging element shapes shown in FIG. 17 and discussed below, where what is required is that no portion of the engaging elements extend beyond the deepest part of the receiving space of the other construction member.

Two L-shapes 250 such as are shown in FIG. 3 can be joined to each other, to form a box, which can be supported from a support panel as shown in FIG. 4 at 262. (For simplicity, the engaging elements have only been shown on two sides of the box 262. However, they may also be present on three or four sides.) Similarly, three construction elements can be joined together to form a "C" or "U" shape, which is not shown. A U-shape is shown in FIG. 13A for a related embodiment, discussed below.

An unsupported surface of a box, L-shaped unit or "U" can in turn form a support surface for an additional single construction member panel, a two construction member L-shape, a three construction member "U" or "C" or a box.

Although the foregoing embodiments have been described as if all of the structures: panels, L-shaped, U-shaped structures, and boxes, were made up from individual, planar construction members 100, it is also possible, and frequently beneficial, to mold the structures unitarily, such as by extrusion molding. In that case, the cross-section (as shown in FIG. 3) remains the same as is described above. The only difference is that there are not two panels, one of which is butted up against the other. There is no seam between the arms of the unit. In general, the term "construction unit" is used herein to describe a structure that has two or more arms, or two or more bases, such as would be the case if it were made from two or more individual planar construction members. A unit may be molded unitarily, or made from individual construction members.

The embodiment of the invention shown in FIG. 2 has engaging elements with triangular side portions, where the triangles are isosceles, with the hypotenuse lying on the face that is shared by an engaging element and a receiving space. This need not be the case as this triangular region can have unequal sides and still provide the meshing function of the invention.

The foregoing discussion describes a relatively simple embodiment, which can be used for many purposes. Another embodiment of the invention has additional features, that provide for more flexible uses. This embodiment will be described with reference to FIGS. 6, 7A, 9, 11, and others. This embodiment may also be made, either from individual construction members, or from unitary extrusion moldings. To facilitate understanding, an individual construction member will be described first.

Figure 6:
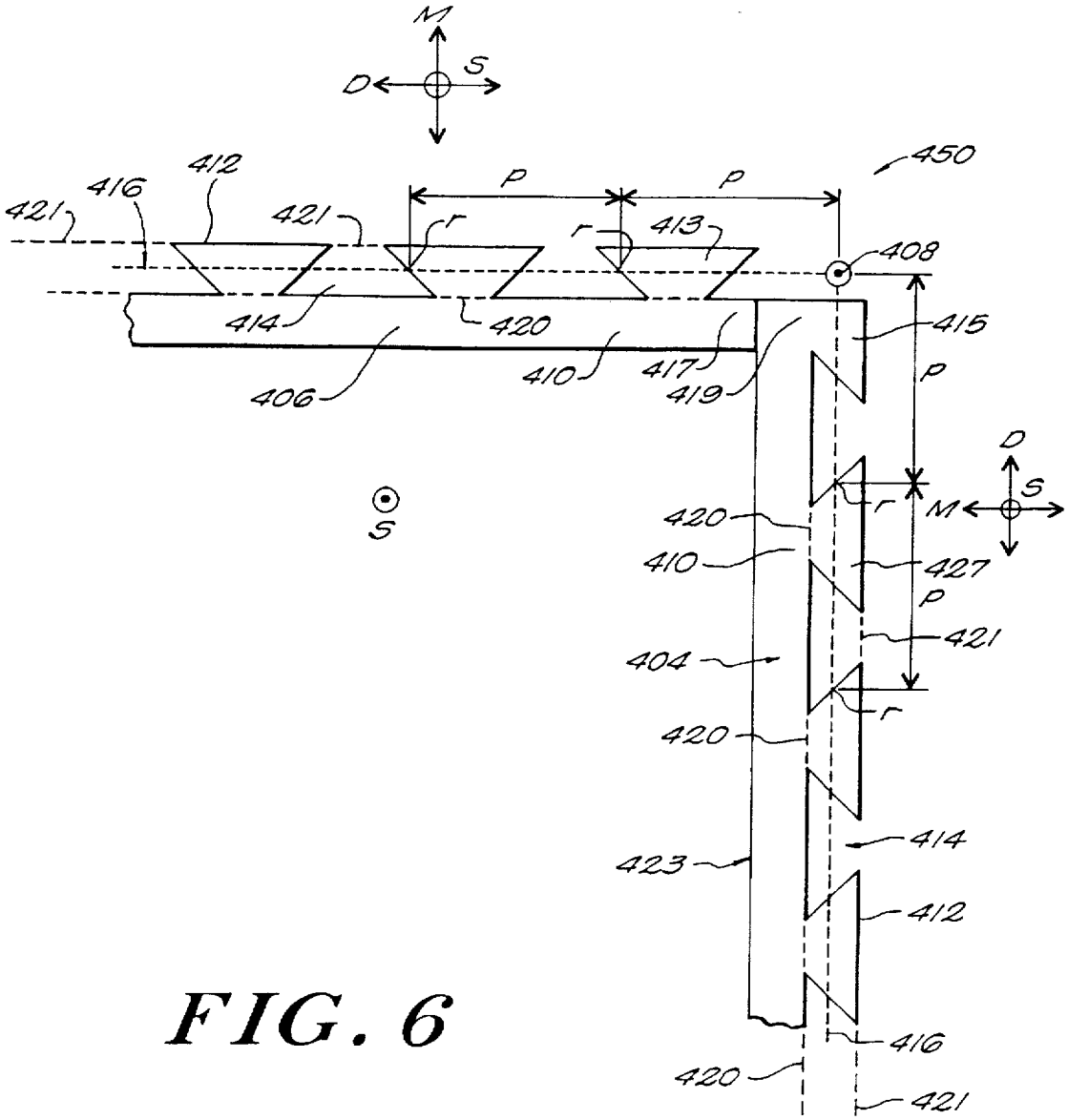
FIG. 6 is an end view of an L-shaped unit having two perpendicular sections, such as could be molded, or made from two construction members of another embodiment of the invention, which provides certain symmetries of connection with other construction members.
Figure 7B:
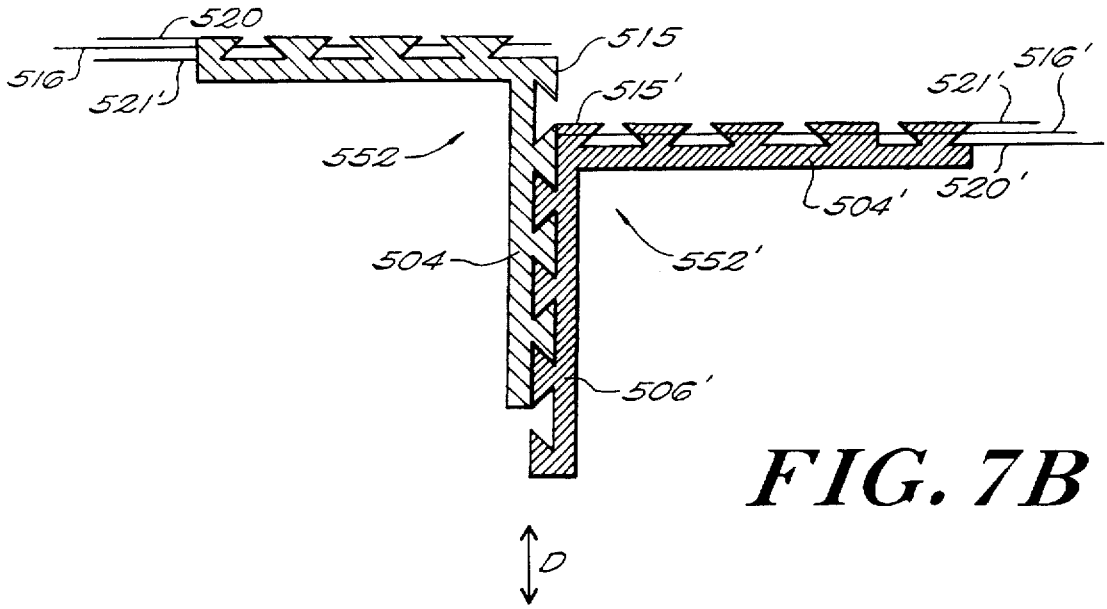
FIG. 7B is an end view of two L-shaped units that are meshed with each other to form a stepped unit.

FIG. 6 shows a preferred embodiment of the invention. An "L"-shaped unit 450 is composed of two construction members 404 and 406 that extend from a virtual corner line 408, which extends into and out of the plane of the figure. The spatial relations among the virtual corner line 408 and the various components of the two construction members 404 and 406 are explained below. The arrangement of the components of the construction members relative to the virtual corner line 408 differ. For this reason, the construction member 404 is referred to herein as the "flush" construction member relative to the virtual corner line 408, and the construction member 406 is referred to as the "butt" construction member relative to the virtual corner line 408.

The reason that these names, "butt" and "flush" have been chosen is somewhat arbitrary, but helps to orient the construction members and their components relative to the virtual corner line 408. As shown in FIG. 6. The end 417 of the butt construction member 406 that is closest to the virtual corner line 408 is butted up against the obverse surface 423 of the flush construction member 404. Conversely, the end 419 of the flush construction member 404 that is closest to the virtual corner line 408 is flush with the narrow end registering plane 420 of the butt construction member 406. Thus, in the following discussion, components of the member that are toward the butt end of a construction member (generally clockwise, as shown in FIG. 6) are referred to as "butt" components, while corresponding components that are toward the flush end of a construction member are referred to as "flush" components.

Like the construction members described above, in connection with FIG. 1A, each construction member has a base 410, from which extend a plurality of spaced apart male, key-like engaging elements 412. Each construction member 404, 406 is generally planar in shape, and can be characterized by a pair of orthogonal dimensions. A sliding dimension S extends into and out of the paper, as shown in FIG. 6. A discrete dimension D extends up and down for the construction member 404, as shown in FIG. 6, and from left to right for the construction member 406. A meshing dimension M is perpendicular to both the sliding and discrete dimensions. The engaging elements 412 are spaced apart along the discrete dimension of each construction member. The engaging elements 412, in one embodiment, are generally continuous and elongated in the sliding dimension. (Again, in another embodiment, described below, they are discontinuous in this sliding dimension.)

The lengths of the construction members in both the sliding and the discrete dimensions can be essentially any length. In many instances, the length in both the discrete and the sliding dimension extend many times the width along the discrete dimension of one engaging element. However, these lengths can also be rather short, even to the point where the engaging elements are not considered to be elongated in the continuous dimension. There is also an embodiment of the invention where the lengths of the construction members in the discrete dimension is critical to provide certain operational flexibilities.

As with the embodiment discussed above, in connection with FIG. 1A, between each pair of engaging elements 412 is a female, keyway like receiving space 414. A boundary plane 416 is parallel to both the discrete and sliding dimensions. The boundary plane 416 bisects the portion of the engaging elements 412, and the receiving spaces 14 therebetween that lie between the narrow end registering plane 420 and the wide end registering plane 421 in the same manner as described above. The boundary plane 416 includes the virtual corner line 408. (Even for the special engaging element shapes discussed below in connection with FIGS. 21A and 21B, the boundary plane bisects that portion of the engaging elements that lies between the narrow end registering plane and the wide end registering plane. There may be an extra portion of the engaging element between the narrow end registering plane and the base, which is not figured into the bisection calculation.)

The surface 423 of the base 410 obverse of the engaging elements 412 is shown as a smooth surface, although this side could also have engaging elements or other surface details as desired (as shown in FIG. 13A for a box 863). As shown in FIG. 6, the engaging elements 412 can be in the shape of conventional dovetails, but other shapes are possible and are described below. The cross-sectional size and shape of the engaging elements 412 is such that each one has a head portion that is wider along the discrete dimension than a neck portion that is closer to the base.

The cross-sectional size and shape of the engaging elements 412 and the receiving spaces 414 is also as described above, such that the engaging elements 412 of one construction member can be slid along the continuous dimension into the receiving spaces 414 of another construction member and vice versa. Once engaged, the sizes of the engaging elements 412 and the receiving spaces 414 are such that the two construction members are substantially locked against relative motion along the discrete and meshing dimensions.

Figure 7A:
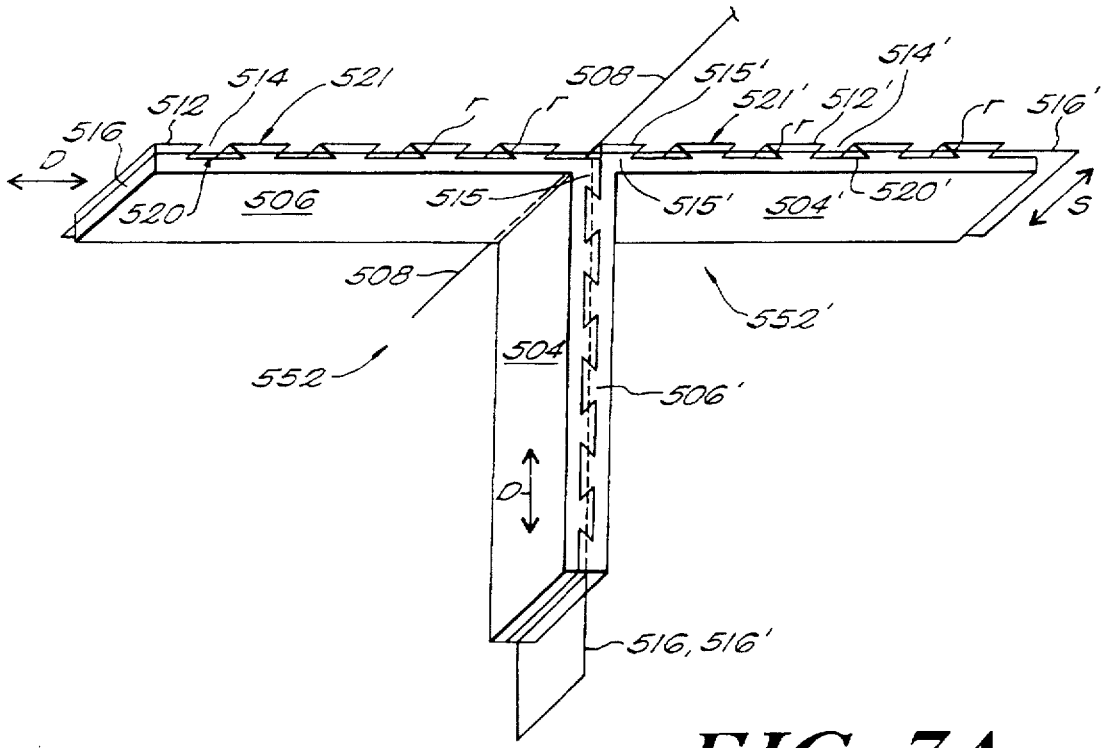
FIG. 7A is a perspective schematic view of two L-shaped units that are meshed with each other to form a T-shaped unit, having a substantially continuous set of engaging elements from one arm of the "T" to the other.

The boundary planes of each construction member are defined, as described above, such that when the two construction members are engaged by meshing with each other, as shown in FIG. 7A, the boundary plane 416 of one construction member substantially coincides with the boundary plane of the other construction member. Further, the narrow end registering plane of one construction member substantially coincides with the wide end registering plane of the other construction member. If the edge of the engaging element is not a straight line, then the reference point may be considered to be located at the point where the boundary plane would intersect the edge of the engaging element if it were a straight line.

The spacing of the engaging elements 412 from the virtual corner line 408 is important. As shown in FIG. 6, each engaging element is characterized with respect to a reference point r. It is convenient to locate the reference point r at the point on the engaging element where the boundary plane 416 intersects the edge of the engaging element. As shown in FIG. 6, the reference point r is at the left-most edge of intersection. For the reason set forth above, this is referred to as the "flush" edge of the engaging element. For each engaging element 412 of the butt construction member 406, the reference point r is spaced an integral number of pitches P from the virtual corner line 408. A pitch P is defined as the spacing between reference points along the discrete dimension, as shown. Similarly, for each engaging element 412 of the flush construction member 404, the reference point r is spaced an integral number of pitches P from the virtual corner line 408.

In a preferred embodiment of the invention, there is a difference in the shapes of the engaging elements 413 and 415 that are closest to the virtual corner line 408 for the butt construction member 406 as compared to the flush construction member 404.

Figure 9:
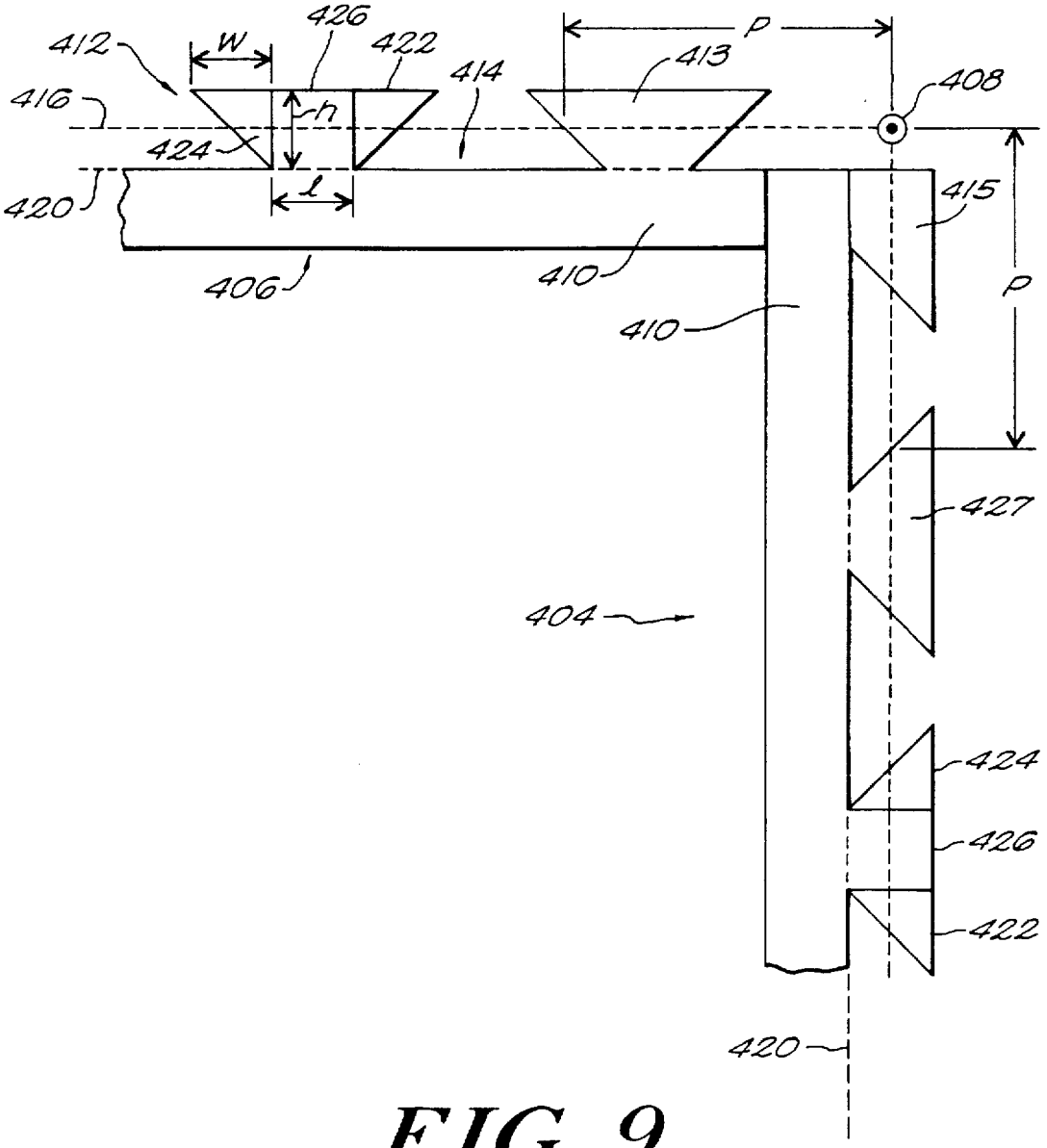
FIG. 9 is an end view of an L-shaped unit similar to that shown in FIG. 6, showing details of an engaging element.

To describe this difference, it is helpful to further break down the components of a dovetail type engaging element 412, as shown in detail in FIG. 9. Each engaging element is made up of a root portion 426, and two ear portions: a butt ear 422 and a flush ear 424. (These three portions are conceptual only. In a typical configuration, the engaging element 412 is a solid piece, with no division between these three portions, having been molded unitarily, typically along with the base 410. Of course, the engaging elements could be made from separate parts, but this is not typically economical or necessary.) The root portion 426 is connected to the base 410 of the construction member, at the narrow end registering plane 420. The ear portions are cantilevered from the root portion, but are not directly connected to the base 410. (The principals for other shapes of engaging elements is similar to that described here for dovetails, and is illustrated below in connection with FIG. 19.)

As shown in FIGS. 6 and 9, on the flush construction member 404, the engaging element 415 that is closest to the virtual corner line 408 is missing the flush ear portion 424. If the flush ear portion were present, the reference point r upon it would fall on the virtual corner line 408. Thus, the engaging element 415 is located zero pitches away from the virtual corner line 408. Further, the boundary plane 416 bisects the hypotenuse of the missing flush ear portion 424 at what would have been its reference point r. This shape allows full translational and rotational interconnection of multiple engaging members, as discussed below. As described below, it is also possible to omit the closest engaging element 415 altogether. The spacing to the reference point r on the next engaging element 427, which is always the first full engaging element from the virtual corner line along the discrete dimension, remains an integral number of pitches from the virtual corner line 408. It is helpful to designate the region between the flush edge of the construction member and the flush edge of a first engaging element having a full representation of the cross-section as the "flush edge engaging region." On the butt construction member 406, the engaging element 413 that is closest to the virtual corner line 408 is typically fully represented.

In a preferred embodiment, the ear portions 422 and 424 are isosceles triangles as shown in FIG. 9, with the width extent w of the ear portion along the discrete dimension being equal to the height distance h along the meshing dimension between the widest and narrowest parts of the engaging element 412. (In another embodiment, discussed below, the ear portions are not isosceles triangles.) The root length 1 of the root portion along the discrete dimension can be any size. All that is required is that the size and shape of the receiving space 414 be such that it can slidingly receive the engaging element and retain it against motion along the meshing M and discrete D dimensions.

The size of the pitch P is based on the size of the components of the engaging element. As shown in FIGS. 6 and 9, the length of the pitch P is:

$$P=2(1+w) \tag{1}$$

which is evident from inspection of FIG. 9, keeping in mind that both the butt 422 and flush 424 ear portions in the embodiment shown in FIG. 9, are isosceles triangles, and the boundary plane 416 bisects the height h=w of each ear portion. For other embodiments where the engaging element does not have isosceles triangles for the ear portions, or where they are not dovetail shapes, the general principal to keep in mind is that the pitch is the distance between corresponding points on adjacent engaging elements, at the location of the boundary plane. It will be recalled that this is midway between the wide end registering plane and the narrow end registering plane.

An advantage of the embodiment of the invention shown in FIG. 9 is that it facilitates building structures of interlocking construction members that can be easily extended to larger structures. A basic joined configuration is shown schematically in FIG. 7A, which shows two identical L-shaped units 552 and 552'. Both are essentially the same as the L-shaped structure 450 shown in FIG. 6, except for the number of engaging elements along their lengths. As shown in FIG. 7A, the two L-shaped units are mated back to back to form a T-shaped unit.

Each L-shaped unit has a butt construction member 506, 506' and a flush construction member 504, 504'. The two L's 552 and 552' are joined, with the flush member 504 of the L 552 meshed with the butt member 506' of the other L 552'. These construction members mate in the same manner as do the embodiment shown in FIG. 2, with their boundary planes 516, 516' coincident, and with the narrow end registering plane of the flush member 504 coincident with the wide end registering plane of the butt member 506'. Further, the wide end registering plane of the flush member 504 is coincident with the narrow end registering plane of the butt member 506'. These registering planes are not shown, for simplicity.

A difference between the structure shown in FIG. 7A and that shown in FIG. 2 is the relative locations of the construction members 504 and 506' along their shared discrete dimension D, with respect to their ends. The relative locations shown in FIG. 2 are not specified. With the structure shown in FIGS. 9 and 7A, it is possible to arrange these two construction members such that the non-meshed construction members (506 and 504') of each L-shaped unit 552 and 552', respectively, present, together, a set of engaging elements 512, 512' and receiving spaces 514, 514', that has the same relative, continuous spacing as would have a single construction member. Thus, the boundary planes 516 and 516' of the two L's are coplanar and meet at the virtual corner line 508. Further, the respective wide end registering planes 521, 521', of the construction members 506 and 504' are coplanar, as are the respective narrow end registering planes 520, 521'. (Note that this differs from the mating arrangement of the meshed construction members 504 and 506', where the boundary planes 516, 516' are coincident, and the wide end registering plane 521' of the construction member 506' is coincident with the narrow end registering plane 520 of the other construction member 504. The registering planes are not shown.) The L's 552 and 552' have been constructed as explained above, such that the reference points r on both the butt member 506 and the coplanar flush member 504' are an integral number of pitches P from the shared virtual corner line 508, as measured along the common discrete dimension of the coplanar members 506 and 504'. Because of this, the spacing between a reference point r on one of the construction member, e.g. 506, to a reference point r on the other construction member 504', is also an integral number of pitches P. Further because of this, another construction member, whose engaging elements are spaced apart a pitch P, can be slidably engaged with the pair of meshed L's, as shown in FIG. 8A.

Figure 8A:
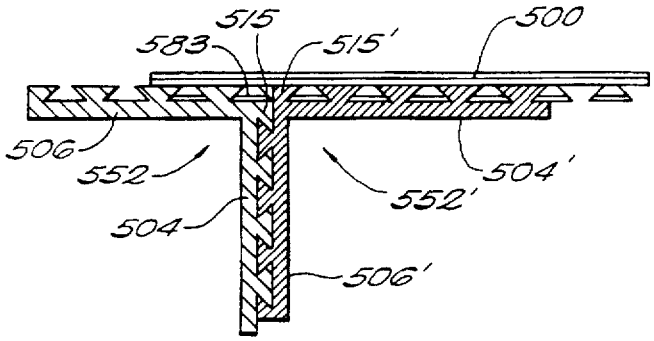
FIG. 8A is an end view of two L-shaped units that are meshed with each other to form a T-shaped unit, having a substantially continuous set of engaging elements from one arm of the "T" to the other, with another construction member that is meshed with both arms of the "T" and bridges across them.

FIG. 8A shows a side view of two L-shaped units 552 and 552' similar to those shown in FIG. 7A, joined in the same manner. Another construction member 500 has been slidingly engaged with both the butt member 506 of the L 552 and the flush member 504' of the L 552', along their mutual sliding dimension (into and out of the page). The bridging construction member 500 is secured against motion along its meshing and discrete dimensions. A feature that is made possible by the specified spacing of engaging elements 512 from the virtual corner line 508 is that the bridging construction member 500 can be slidingly engaged with the top of the "T" formed from the two L's 552 and 552' at any relative location along the discrete dimension of the bridging member 500.

Figure 8B:
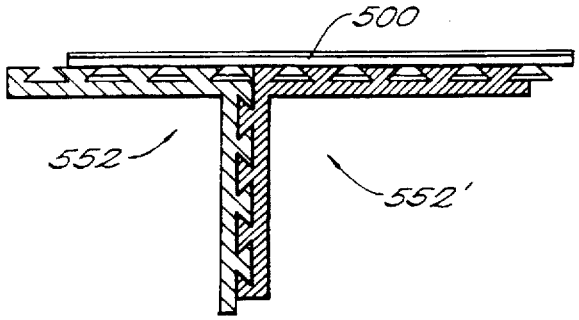
FIG. 8B is an end view of the assembled construction member shown in FIG. 8A, with the bridging member located one engaging element to the left of the positions shown in FIG. 8A.

This is shown schematically by comparison of FIGS. 8A and 8B. FIG. 8B shows the construction member 500 shifted one engaging element to the left, relative to it's position in FIG. 8A. This ability to shift a construction member and still mesh it is referred to herein as "translational symmetry." This enhances the flexibility of joining the construction members together, and increases the range of shapes and arrangements that can be made from numerous construction members. This mutual engagement, among the two L's and the bridging construction member enhances the rigidity of the combined structure, particularly against skewing that would tend to reorient the perpendicular construction members 504 and 506 of a single L 552 to a non-perpendicular orientation.

Another special feature of the construction members of the invention enables this bridging configuration of the bridging construction member 500. That feature is the missing flush ear portion of the corner engaging element 515 of the flush construction member 504 of the L 552. If a flush ear portion were present on this engaging element 515, that portion would interfere with the engaging element 583 of the bridging construction member 500, or whatever engaging element were adjacent to it.

At first, it might seem to be possible to provide the bridging feature without colliding with the corner engaging element 515, by shifting the spacing of the engaging elements on the construction member 504 downward as shown, away from the virtual corner line 508. However, it must be kept in mind that the construction member 504 is the same size and shape as the construction member 504'. If such a shift were made, then the spacing of the engaging elements on the construction member 504 would be similarly shifted, and that would throw off the equal pitch spacing P between reference points from one construction member 506 to another construction member 504', across the arms of the "T". Thus, shifting the spacing to avoid the collision with the flush ear portion would destroy the potential bridging capacity.

A similar functionality would also arise if the entire engaging element 515 were missing, and such an embodiment is contemplated as part of the invention. Again, there would be no collision. However, with that embodiment, there may be slightly less cohesiveness between any construction members that are mated to the construction member 504. Further, the appearance would differ, with a relatively large gap showing. In some cases, this may be aesthetically undesirable.

In fact, if both of the corner engaging elements 515 and 515' were fully represented it would not be possible for the two L's 552 and 552' to mate and present a continuous, planar set of engaging elements 512 and 512' for engagement with a bridging member 500, because the flush ear portions would interfere with each other. Thus, at least one must be absent.

The bridging construction member can be in the position of the under desk construction member 103 shown in FIG. 4, and the two L's 552 and 552' can be portions of boxes, as described more fully below (similar to the box 262 shown attached to the computer case), which can be locked to each other and then located at any position along the discrete dimension of the bridging member 500. Similarly, the two L's 552 and 552' could be supported from the bottom of the construction member 300, which itself is part of an L shaped unit 265, supported by the monitor case. Rather than the bridging construction member being oriented with its engaging elements pointing downward, it could be oriented with the engaging elements pointing upward, such as is shown by the construction element 101 on top of the monitor 267. The L's can be part of boxes (862, 863, FIG. 13A), U-shaped units (869 FIG. 13A), or simply L's, or any combination thereof.

It will be readily understood further that the bridging construction member 500 may be a fixed vertical support, such as the construction element 107 shown in FIG. 4. Then the mated L's can be moved to any vertical position relative to this support, even while mated together. Again, the mated L's can be parts of boxes, or U-shaped units, or simply L's.

Another special feature is made possible because the corner engaging element 515' of the flush member 504' that is closest to the virtual corner 508 is missing its flush ear portion. Because that flush ear portion is missing, the L-shaped unit 552' can be engaged with the construction member 504 anywhere along the discrete dimension of the construction member 504, for the same reason that the L-shaped unit 552 can be mated to the bridging member 500 through its butt construction member 506, anywhere along the length of the bridging construction member 500.

Figure 10:
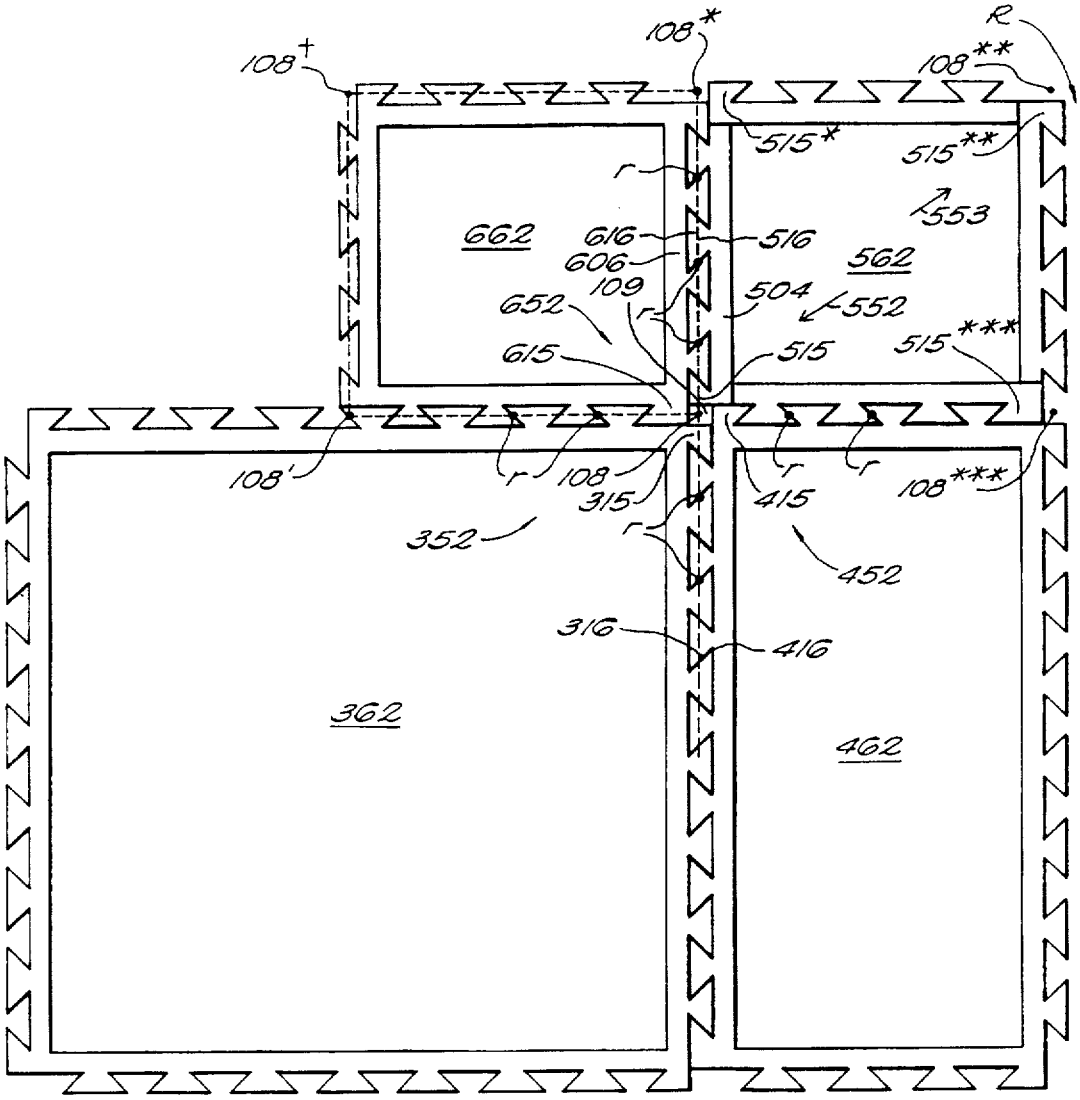
FIG. 10 shows schematically in an end view four rectangular parallelepiped boxes embodying the construction member of the invention, where the collection of boxes exhibit both rotational and translational symmetries.

The combined features of always maintaining the spacing of the reference point r an integral number of pitches P from the virtual corner line and providing the corner engaging elements without flush ear portions is illustrated with respect to FIG. 10. Four boxes, 362, 462, 562 and 662 are shown in an end view, each meshed to two other boxes surrounding a virtual corner line 108, which extends into and out of the plane of the figure. Each of the boxes includes an L-shaped unit 352, 452, 552 and 662, essentially identical to the L-shaped units 552, 552' described above in connection with FIGS. 7A, 8A and 8B. Each L-shaped unit has a corner engaging element 315, 415, 515 and 615, which has no flush ear portion, and which is adjacent to the corner line 108. It can be seen that an empty square 109 surrounds the corner line 108 and is bounded by the root portions of the corner engaging elements 315, 415, 515 and 615. If any one of the flush ear portions were present, it would take up one-half of the empty space 109 (in the form of a triangle), and the virtual corner line would bisect the hypotenuse of the triangle that forms the cross section of the flush ear portion. It would not be possible for two mated boxes to both have fully represented corner engaging elements, without their flush ear portions interfering with each other.

Thus, it can be seen that the features discussed above facilitate intermeshing four L-shaped units 351, 452, 552 and 652 in much the same manner that two L-shaped units 552 and 552' are mated and meshed to the bridging construction member 500 shown in FIG. 8A, except that as shown in FIG. 10, a pair of mated L-s combine to present a bridging construction member-like set of engaging elements. For instance, the coplanar construction members that are part of L-shaped units 352 and 652 establish a bridging construction member-like set of engaging elements for the two L-shaped units 452 and 552.

The features also provide a rotational symmetry. If the box 562 is made up of two L-shaped units 552 and 553, joined such that each corner of the box is identical to any other corner of the box (thereby presenting four identical L-shaped units), it is possible to remove the box 562 from its meshing relationship with the other boxes, rotate it 90, 180 or 360 degrees, in either direction, for instance as shown by the arrow R, and to replace the rotated box into meshing relationship with the other three. Thus, it is symmetric with respect to rotation about an axis that is parallel to the virtual corner line 108 and in the center of the box.

This is a great advantage to the user who is constructing a network of such boxes, because the user need not pay any attention to the rotational orientation of any one box relative to any of the other boxes. It will always fit, as long as attention is paid to which is the front and which is the back of the box.

It is also not even necessary that the box be a square for this feature to exist. Inspection of FIG. 10 reveals that if the non-square rectangular box 462 is rotated clockwise 90°, the rotated box will also intermeshingly engage with the large square box 362 and the smaller square box 562. There will, however, be an overhang on each side.

It should be noted that all of the reference points r (which, it will be recalled, are located on the flush ear portion of each engaging element, at the point where the boundary plane (316, 416, 516, 616) bisects the hypotenuse of the flush ear portion) are located an integral number of pitches P from the virtual corner line 108. It should also be noted that, with respect to the virtual corner line, with each pair of meshed construction member, one is a butt construction member and the other is a flush construction member. For instance, a flush construction member 504 is meshed with a butt construction member 606.

But, the appellations "butt construction member" and "flush construction member" are relative only, to a single virtual corner line. As shown in FIG. 10, the construction member 504, which is a flush construction member relative to the virtual corner line 108, is a butt construction member relative to the virtual corner line 108*. The converse is true with respect to the construction member 606. What this means is that the reference points r are located an integral number of pitches from both virtual corner lines 108 and 108*, and further imposes a requirement on the total length of the base of a construction member. This is shown in more detail with reference to FIG. 11.

Figure 11:
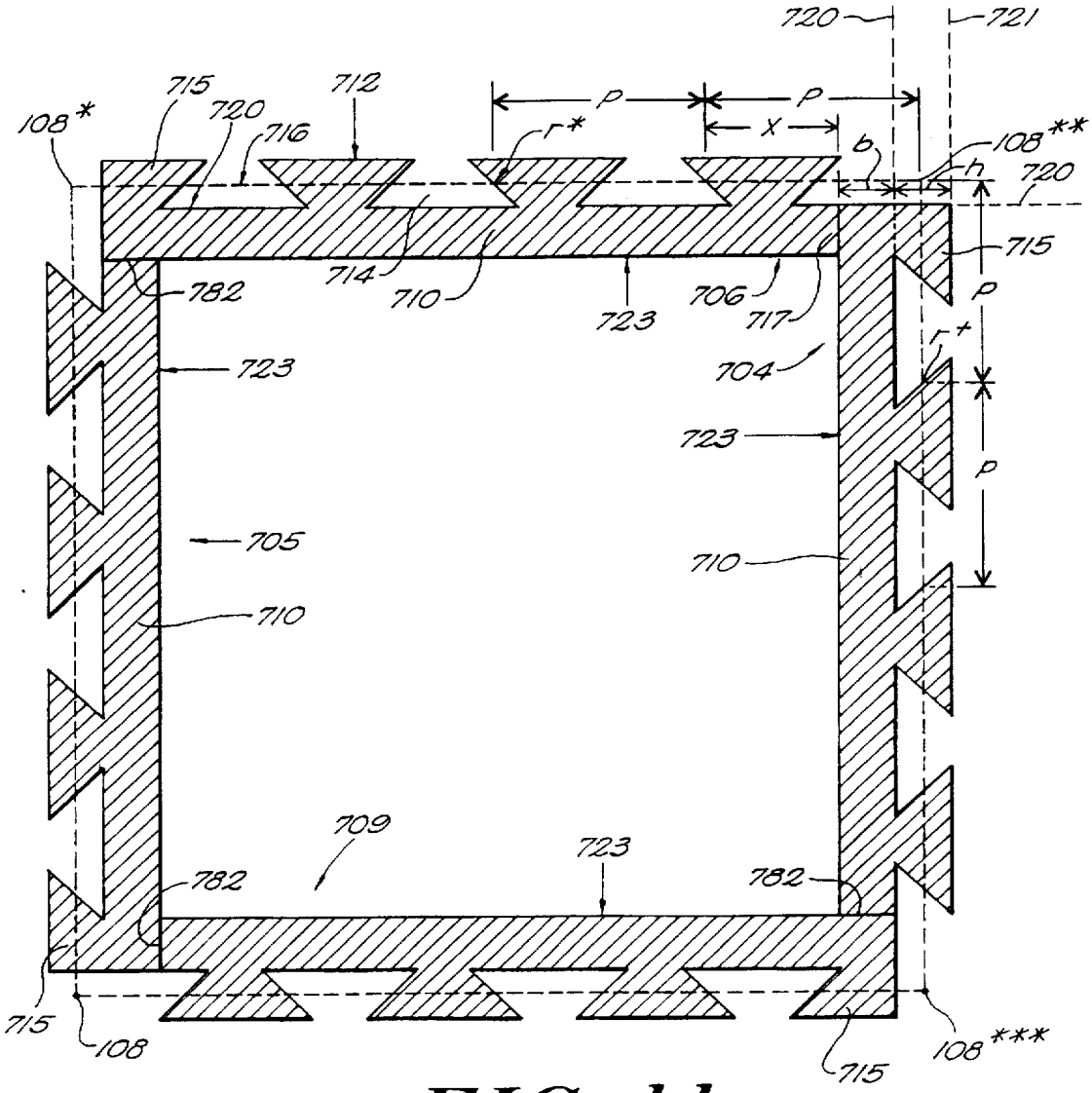
FIG. 11 shows schematically a box that may be made from planar construction members or a unitary mold, showing the details of the locations of the engaging elements relative to a virtual corner line, and the location of a virtual box used for sizing the construction members.

FIG. 11 shows a box embodiment of the invention, in an end or cross-sectional view. The box is made up of four construction members, 704, 706, 705 and 709. One end of a construction member 705 is butted up against the obverse surface 723 of the construction member 706, the end of which is butted up against the obverse surface 723 of the construction member 704, the end of which is butted up against the obverse surface of the construction member 709, one end of which is butted up against the obverse surface of the construction member 705. Thus, each of the construction member can be thought of chasing the next, with the butt end of one butted up against the obverse surface of the flush end of the next. In each case, the corner engaging element 715 is cut off, having no flush ear portion, so that the end formed by its root portion is flush with the narrow end registering plane 720 of its adjacent construction member.

As shown, the reference point r* is located two pitches 2P away from the virtual corner line 108* and two pitches 2P away from the virtual corner line 108, at the other end of the construction member 706. Similarly, the reference point r† is located one pitch from the virtual corner line 108** and three pitches from the virtual corner line 108***. This requires that there be a special relationship among the distance between any reference point r, the end 717 of the construction element 706 that is closest to the virtual corner line 108**, and the distance from the obverse surface 723 of the construction member 704 to the virtual corner line 108**. The distance between the closest reference point to the virtual corner line 108** and the butt end 717 of a construction member is defined as x. It will be recalled that the virtual corner line 108** lies half way between the narrow end registering plane 720 and the wide end registering plane 721 of the construction member 704. The thickness of the base 710 along this dimension is defined as b, and the distance between the narrow end registering plane and the wide end registering plane, as defined in connection with FIG. 9**, is h. Thus, for dovetail engaging elements having isosceles triangle shaped ear portions, the following relation obtains:

$$P=x+b+h/2. \quad (2)$$

Thus, the length of a construction member, the thickness of its base, and the dimension of the engaging elements between the two registering planes are all related and must be balanced with the above relation in mind. If b is so large that the tip of the dovetail closest to the virtual corner line 108** overlaps the thickness b of the other panel, then equation 2 must be adjusted to account for this overlap, by subtracting the amount of the overlap from the total. In general, there is a limit on the size of b when the unit is constructed from separate members.

Thus, a preferred embodiment of the invention has many useful features. This embodiment allows the construction of structures that may be mated to each other to form L's or boxes, which L's can be mated such that they present a planar, continuous set of engaging elements, which can themselves be meshed with engaging elements on a unitary bridging member, or another pair of coplanar construction members. The bridging member or members and the coplanar members can be located relative to each other any where along the discrete dimension. Boxes can be constructed, which can be mated such that four boxes are adjacent each other, each of the four being meshed with two adjacent other boxes, forming a strong and useful arrangement. Each of the boxes can be rotated, and still will fit into the network. One of the four boxes can be removed, and the other three will remain connected.

Figure 31:
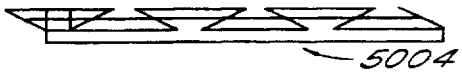
FIG. 31 is a schematic end view representation of a construction member of the invention having dovetail shaped engaging elements where the ear portions are triangles that are wider than they are tall, where no part of the corner engaging element has yet been removed.
Figure 32:
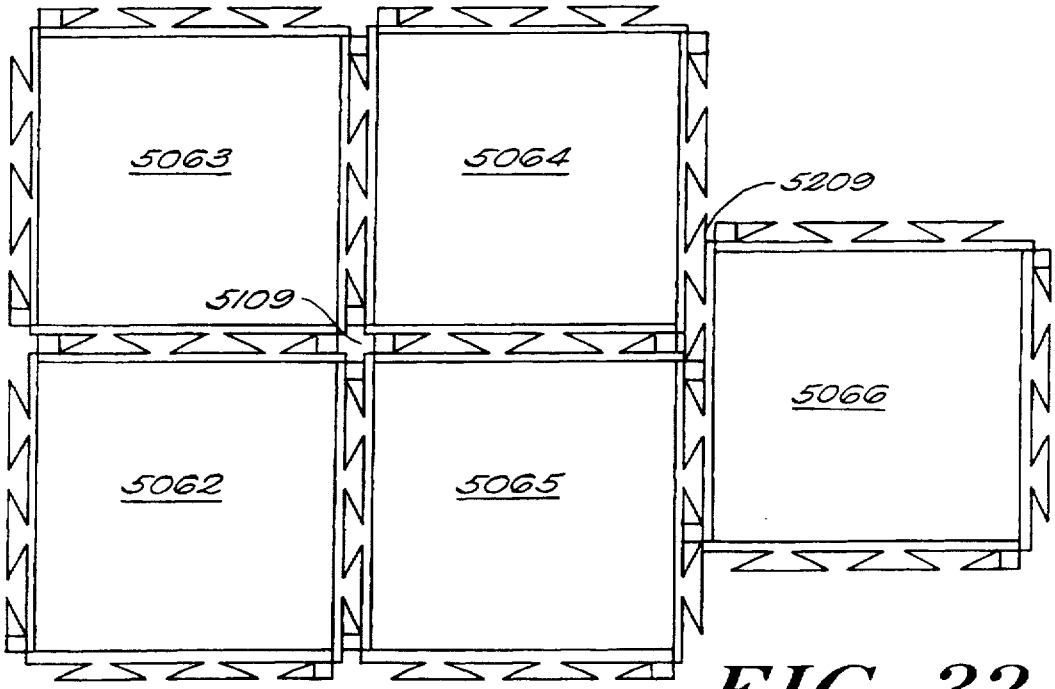
FIG. 32 is a schematic end view representation of a network of five boxes made from construction members such as are shown in FIG. 31, but with the flush ear portion of the corner engaging element removed.

In the embodiment discussed above, illustrated, for instance in FIGS. 6, 9, 10 and 11, the engaging elements are described as dovetails, having triangular ear portions, where the triangles are isosceles. As discussed below, it is not required that the shape of the engaging element be a dovetail. Further, if the engaging element is substantially in the form of a dovetail, it is not required that the triangular ear portions be isosceles. For instance, as shown in FIGS. 25, 26, 27, 28, 29 and 30, the ear portions may be taller, along the meshing dimension, than they are wide, along the discrete dimension, or, as shown in FIGS. 31 and 32, vice versa.

Figure 28:
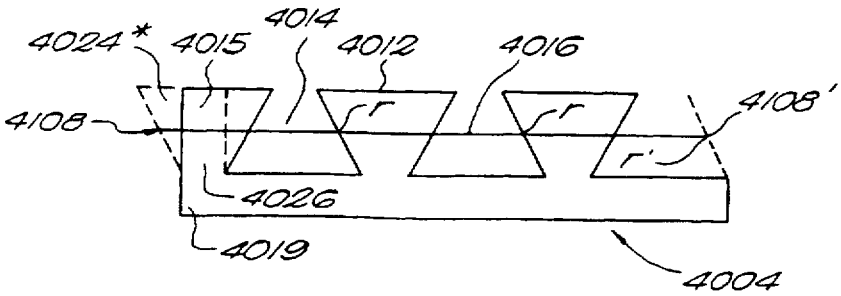
FIG. 28 is a schematic end view representation of a construction member of the invention having dovetail shaped engaging elements where the ear portions are triangles that are taller than they are wide, where part of the root portion has not been removed.

A single arm construction member 4004 as discussed above, with the flush ear portion of the corner engaging element 4015 removed, is shown schematically in FIG. 28. A single arm 4004' that has been modified with some of its root portion of the corner engaging element 4015, and some of the base of the flush end also removed is shown in FIG. 25.

The general principals of engaging element shape and location discussed above still apply. With reference to FIG. 25, each engaging element 4012 has a reference point r located at the midpoint of the hypotenuse of the flush ear portion 4024, which is at the point that the boundary plane 4016 intersects and bisects the hypotenuse. Each engaging element 4012 must be located so that this reference point is an integral number of pitches away from whatever virtual corner 4108, 4108' lines are applicable. The flush edge 4019 of the corner engaging element is cut so that it will be flush with the narrow end registering plane of the butt construction member, and still be located with what would have been its reference point on the virtual corner line 4108. The corner engaging element 4015 is located zero pitches away from the virtual corner line 4108. Further, the boundary plane 4016 bisects the hypotenuse of the missing flush ear portion 4024* at what would have been its reference point r.

Figure 25:
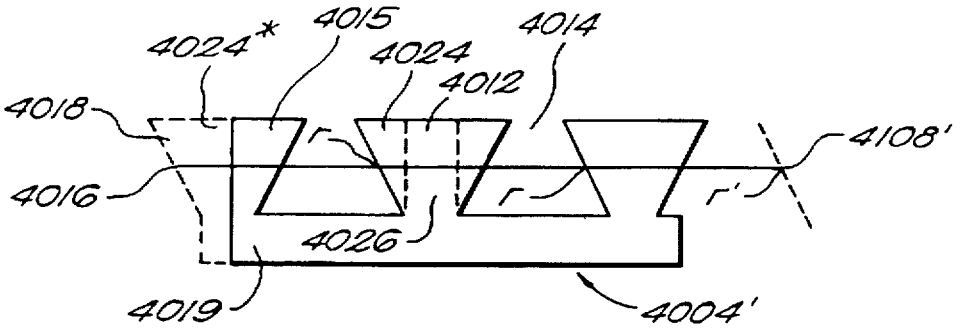
FIG. 25 is a schematic end view representation of a construction member of the invention having dovetail shaped engaging elements where the ear portions are triangles that are taller than they are wide, where part of the root portion has been removed.
Figure 26:
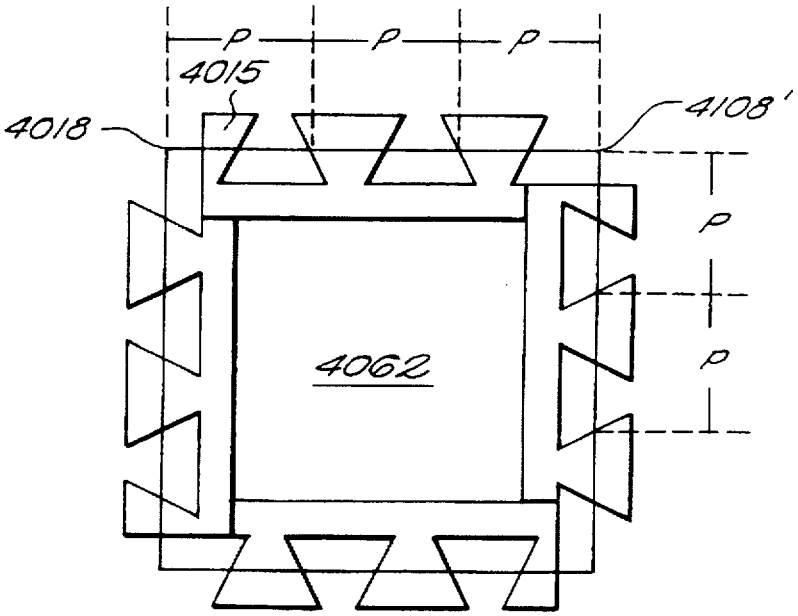
FIG. 26 is a schematic end view representation of a box unit constructed from construction members such as are shown in FIG. 25.

A difference is that in many cases, it is necessary to remove not only the entire flush ear portion 4024 of the corner engaging element, as shown in FIG. 28, but also a portion of the root 4026 as shown in FIG. 25. The amount that must be removed depends on the difference between the height and width of the ear portions. Generally, the larger the difference, the larger the portion of the root that must be removed. In many cases, it will be practical to remove the entire corner engaging element 4015, as the root may be required to be so small as to have no structural integrity.

Figure 27:
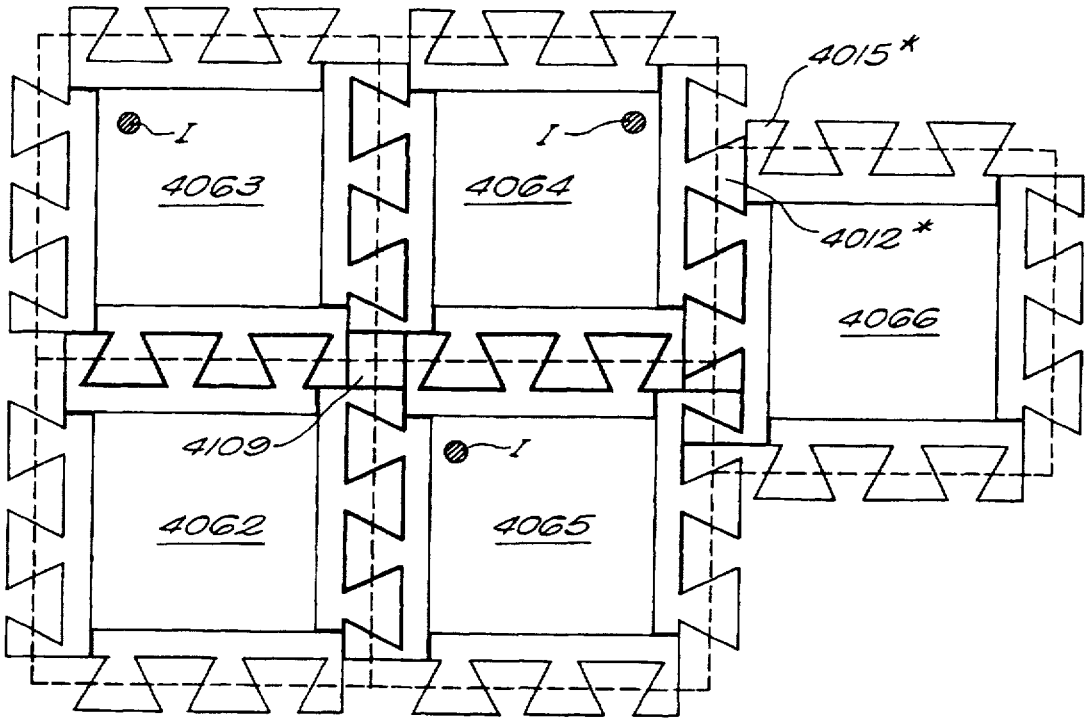
FIG. 27 is a schematic end view representation of a network of five boxes such as are shown in FIG. 26.

As shown in FIG. 27, an empty region 4109 must be maintained at the intersection of four, identical L-shaped units that are parts of the four identical square boxes 4062, 4063, 4064 and 4065. The empty region is required so that the corner engaging elements of boxes arranged relative to each other such as 4065 and 4064 do not interfere with each other. This is maintained by removal of the flush ear portions 4024 of each construction member arm, and part of the root portions 4026.

Figure 29:
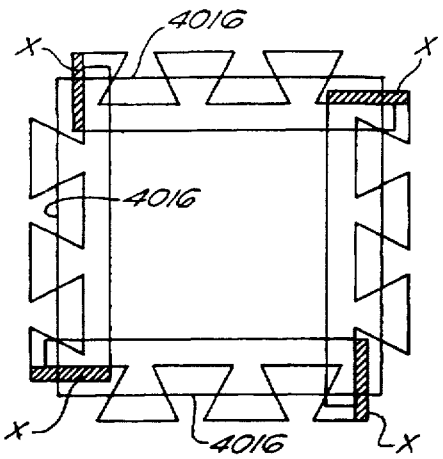
FIGS. 29 and 30 are schematic representations of a method for determining how much of the root portion of the construction member shown in FIG. 28 should be removed to facilitate the rotational and translational symmetries of a preferred embodiment of the invention.
Figure 30:
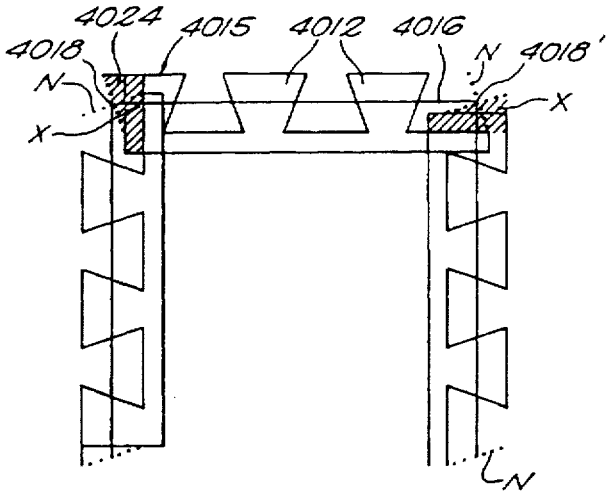

The designer will readily understand that a reasonable manner to determine how much of the root portion to remove is illustrated schematically with reference to FIGS. 29 and 30. A cut out or CAD image of a construction member having a full representation of all of its engaging elements is overlaid with two identical perpendicular construction members. The position of the flush edge of what would be the next, engaging element at the other end of the construction member is also noted, as shown by the dotted lines N. The hypotenuse of the flush ear portion 4024 of each corner engaging element 4015 is arranged so that it is bisected at the virtual corner line 4108. The construction member is also arranged so that the bisection of the hypotenuse of the dotted line N that would be the flush ear of the next engaging element along the discrete dimension in the butt direction is bisected by the virtual corner line 4108' at the other end of the construction member. This is done for each construction member of the desired unit (either an L shape, a U shape, as shown in FIG. 30, or a square, as shown in FIG. 29) and the regions X where the corner engaging element would extend beyond the narrow end registering plane of the construction member that shares a virtual corner line are noted. The regions of extension must be removed, because, as can be seen with reference to FIG. 27, these regions must be kept open to allow the four L-shaped pieces to meet, and also to allow translational symmetry, as is demonstrated by the location of the box 4066, where the corner engaging element 4015* is adjacent an engaging element 4012* on the box 4064.

FIG. 27 also demonstrates that any one of the identical boxes 4063, 4064, 4065, 4066 could be removed and rotated, as is noted by the index dot I.

As mentioned above, rather than being taller than they are wide, the ear portions of the dovetails can also be wider than they are tall, as shown schematically with reference to FIG. 31. Using the same principals discussed above, a construction member 5004 can be formed, and associated with identical construction members to form the types of units discussed above, for instance boxes 5062, 5063, 5064 5065 and 5066 as shown in FIG. 32. If the entire flush ear portion of the corner engaging element is removed, then a cross shaped space 5109 is formed at the intersection of the boxes, and a small space 5209 is formed between an L-shape mated with a panel, as at the corner of the box 5066 mated with the side of the box 5064.

The cross-shape and the small space 5209 are due to the fact that the entire flush ear portion of the dovetail has been removed. In fact, less than that need be removed when the dovetail ear portions are wider than they are tall. Thus, if the designer chooses, a bit of the flush ear portion could be retained.

Thus, if a dovetail is used as the shape for the engaging element, it can have isosceles triangular shaped ear portions, in which case, all of the flush ear portion is removed. If the ear portions are taller along the meshing dimension than they are wide along the discrete dimension, then the flush ear and part of the root portion are preferably removed. If the ear portions are wider than they are tall, then all of the root portion can remain, and a part of the flush ear portion can also remain, if the designer desires. What should still obtain is that the reference points of each of the engaging elements should be spaced an integral number of pitches from the virtual corner lines, and the virtual corner line should bisect the hypotenuse of the flush ear portion of the corner engaging element.

Most of the foregoing discussion has generally assumed that the constructed units of panels, L-shapes, U-shapes and boxes, will be assembled from individual, generally planar construction members, such as are shown in FIG. 1. This is certainly one preferred embodiment. However, it is also possible to extrusion mold units, with the die being shaped according to the cross-section of the desired unit, such as a box shown in FIG. 11, an L shown in FIG. 6, or a U shown in FIG. 13A. Extrusion, or other appropriate molding may provide economies or other advantages for some situations. In that case, taking the box shown in FIG. 11 as an example, the final unit is the same, except there are no seams 782 in the places where the butt member butts up against the flush member. Such a box is shown in perspective in FIG. 12.

Figure 13B:
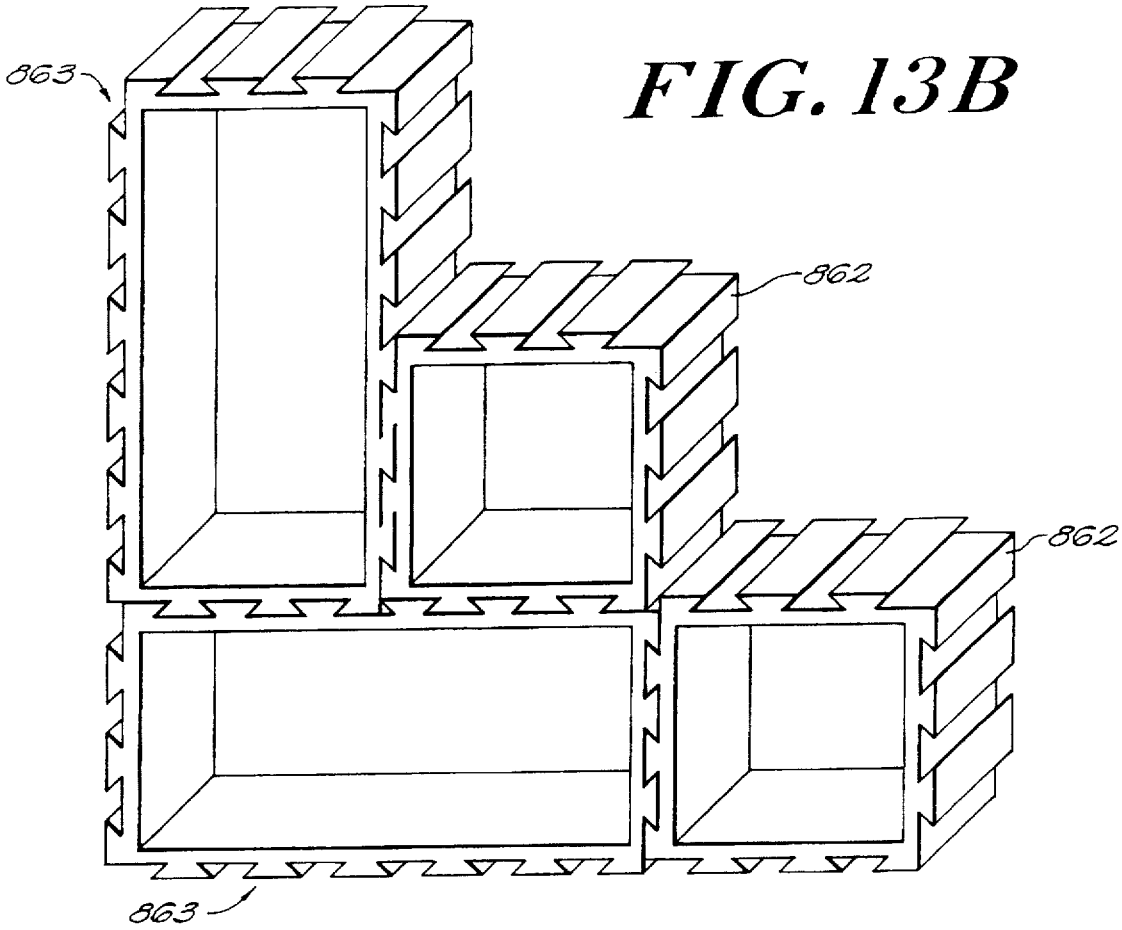
FIG. 13B shows schematically, in perspective view, two square boxes, and two rectangular boxes, all having sides with lengths that are an integral number of times the length of the smallest side of any box.

A convenient embodiment of the invention is shown in FIG. 13B, where two square box units 862 are meshed with two rectangular box units 863. As can be seen, the long length of the rectangles 863 is twice the length of one side of the squares 862. This permits many different combinations of arrangements, where small units can be used alone, or combined with other small units to compose a larger unit, having matching dimensions with another unitary larger unit. In general, it is convenient if parallelepiped box units are constructed, where the lengths of the sides of all of the boxes are integral multiples of the length of the smallest side in the set. FIG. 10 also shows an arrangement of four boxes, where the small boxes 662 and 562 are squares, the rectangular box 462 has a side that is twice as long as a side of the square boxes, and a larger square 362 has sides that are also twice as long as the sides of the smaller square boxes.

The "length" of the side of a box, is defined as the distance between adjacent virtual corner lines e.g. 108 and 108*, as shown in FIG. 11. Thus, the length of the side of a box is a bit shorter than the distance between the wide end registering planes of opposite facing sides. In general, network geometries can be planned based on the dimensions of the "virtual boxes" that have sides which correspond to the portions of the boundary planes 716 between virtual corner lines 108. It will be understood, particularly with reference to FIG. 10, that because the meshed boxes protrude into the spaces occupied by each other, the virtual box is in reality the best stand-in for an outline, or box perimeter, when figuring network configurations.

Figure 14:
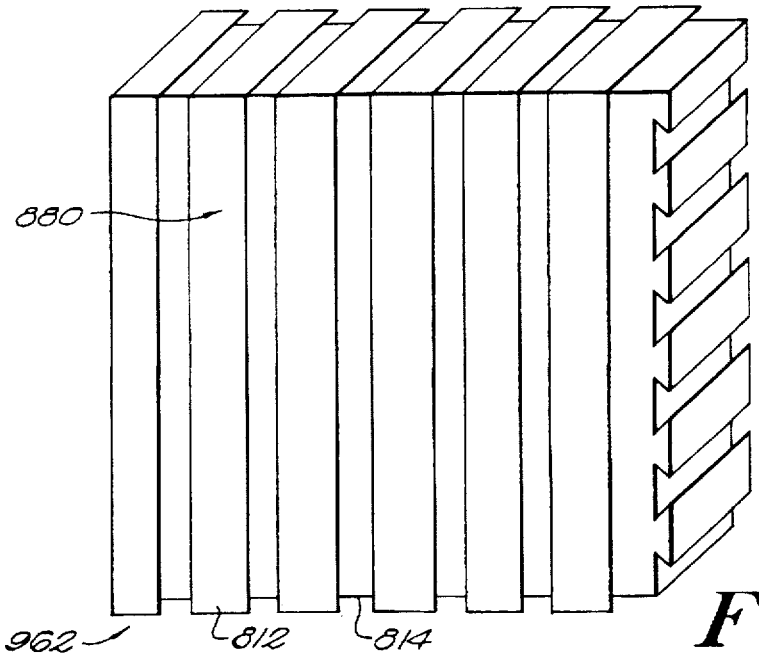
FIG. 14 shows schematically, in perspective view, an embodiment of the back side of a box.

The boxes may be open ended at both faces, or they may be closed at one or both faces. FIG. 14 is a back perspective view, showing a box 962 that has a back 880 that is a construction member, with engaging elements 812 and receiving spaces 814 which extend generally parallel to the engaging elements on two faces, and perpendicular to the engaging elements on two other faces. In most cases, if both ends of the box are closed, there should be some way to remove one of the closed ends, such as by a snap fit, hinge, etc.

On the other hand, one use for the construction element of the invention is as a child's toy, similar to Lego™ brand blocks. In such a case, it would not be necessary for the box to be openable.

Figure 15:
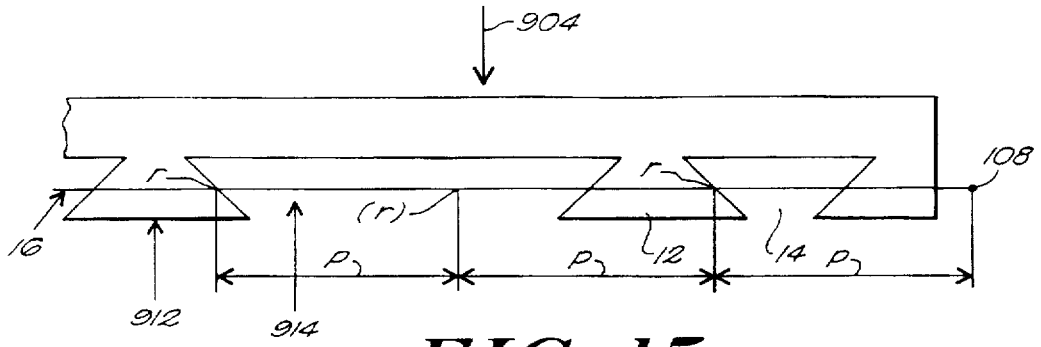
FIG. 15 shows schematically, in an end view, another embodiment of the invention where the engaging elements are not regularly spaced relative to each other.

The foregoing discussion has centered on construction members that have a regular arrangement of engaging elements and receiving spaces, spaced along the discrete dimension, each engaging element being spaced a distance P from the adjacent engaging element. However, in another preferred embodiment of the invention, one or more engaging elements in the regular pattern are omitted. Yet it still retains much of the functionality of other embodiments. As shown in FIG. 15, a construction member 904 is oriented relative to a virtual corner line 108 as discussed above. It has a receiving space 14 and an engaging element 12, as described above. The reference point r of the engaging element 12 is spaced one pitch P from the virtual corner line 108. Adjacent the engaging element 12 is a modified receiving space 914, which is larger than a typical receiving space 14. In fact, it occupies the space of two adjacent receiving spaces and the engaging element that would have been between them. The reference point r of the next engaging element 912 is spaced three pitches 3P from the virtual corner line 108. There is no reference point on an engaging element that is located a distance 2P from the virtual corner line 108. (It's position is indicated at (r).)

The absence of one or more engaging elements 12, either adjacent or spaced apart from each other, does not affect the ability of the construction member to mesh with another construction member in face-to-face relation, as shown in FIG. 2 or P, for instance, as long as there are enough engaging elements 12 that are present to provide the desired amount of engagement. What is required is that the engaging elements that are present be located with their reference points an integral number of pitches P from the reference point on every other engaging element. It should be noted that the feature of omitting one or more engaging elements can be used with either of the two major embodiments discussed above: the embodiment discussed above with respect to FIG. 2, where the spacing of the engaging elements is not specified relative to an end of the construction member, and where translational symmetry and rotational symmetry is not necessarily available; and the embodiment discussed above with respect to FIG. 6, where the spacing of the engaging elements from a virtual corner line is important, and where the flush end engaging element is either missing entirely, or missing at least its flush ear portion, where translational and rotational symmetry are available.

Figure 16:
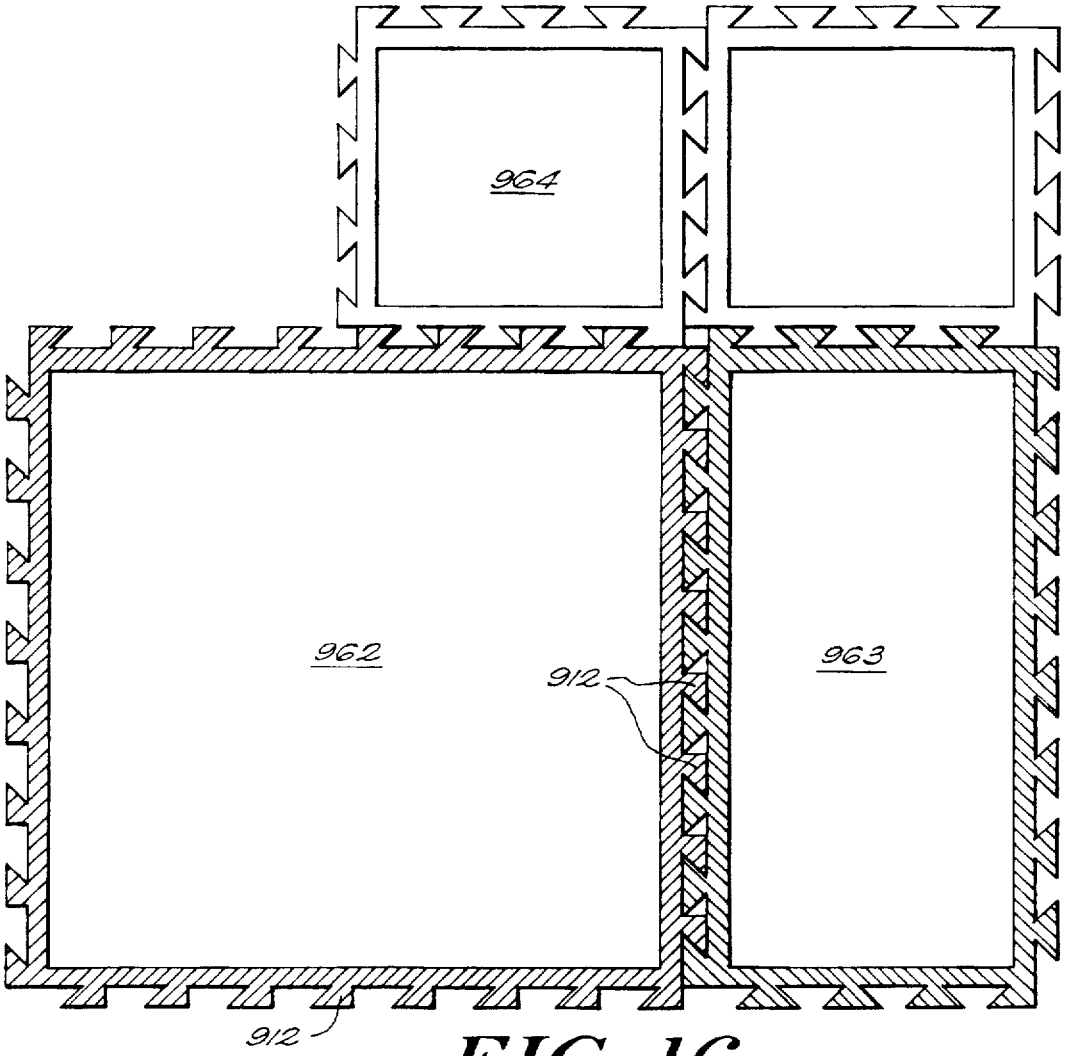
FIG. 16 shows schematically, in an end view, an embodiment of the invention where the engaging elements of some units are all missing a portion that is present in other embodiments.

Another embodiment that uses only partial engaging elements is shown with reference to FIG. 16. A box 962 is made of construction members that have engaging elements 912 that are all missing their flush ear portion. As long as the engaging elements on the mating boxes 963, 964, are fully represented, the mating between the box 962 and the other boxes will prevent relative motion of the engaged construction members along their mutual discrete and meshing dimensions. Further, both the translational and the rotational symmetry would still arise. One drawback of this embodiment is that if one of the sides of the box 962 is mated with another side that has the same engaging element configuration, that mating will not be secure, because the spaces where the two missing flush ear portions would have been would be adjacent each other, and would thereby allow motion.

Rather than having every flush ear portion be absent, it is possible to omit only some of the flush ear portions. Similarly, some flush ear portions and some butt ear portions can be omitted. However, in all of these cases, the mating construction member must have engaging elements in certain locations, to insure that there will be adequate mating retention. In general, the translational and rotational symmetries are harder to achieve when the engaging elements are not fully represented along the length of the construction member or unit side.

The foregoing discussion has illustrated embodiments of the invention having engaging elements that are generally dovetail shaped, having a triangular cross-section. The receiving spaces have the same, triangular cross-section. However, other shapes are possible, and, in fact, it is not required that the engaging elements and the receiving spaces have the same shapes as each other.

What is required is that the engaging element have a width along the discrete dimension, at the wide end registering plane, that is wider than a width of the engaging element at the narrow end registering plane, with the narrow end registering plane being located closer to the base of the construction member than is the wide end registering plane. The receiving spaces must also have substantially the converse sizes at the registering planes: narrow width spaces at the wide end registering plane and wide width spaces at the narrow end registering plane, in order to receive the engaging elements of a similar construction member.

Figure 17:
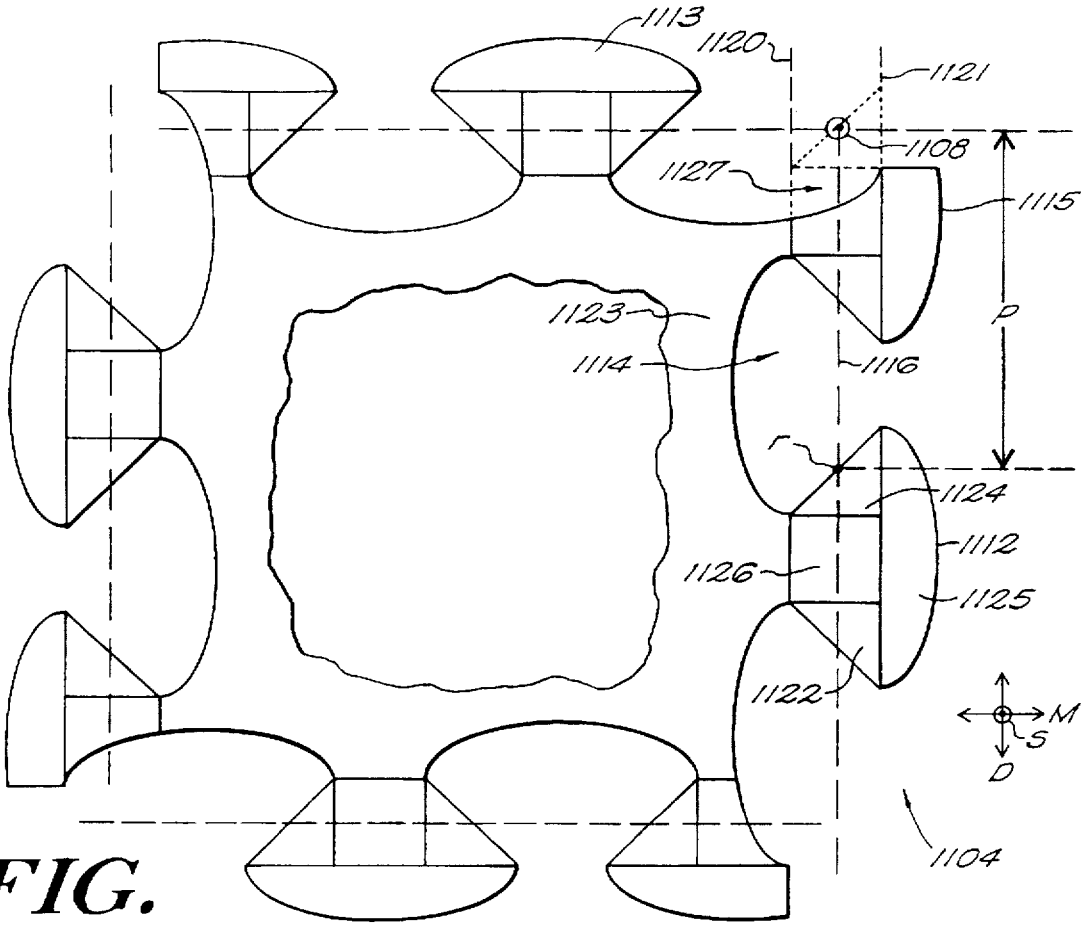
FIG. 17 shows schematically, in an end view, an embodiment of the invention having mushroom shaped engaging element.

An example of such a construction member 1104, is shown schematically in FIG. 17. Rather than dovetail shaped engaging elements and receiving spaces, it has generally mushroom shaped engaging elements 1112 and receiving spaces 1114. The widest part of the engaging elements 1112 (and the narrowest part of the receiving spaces 1114) along the discrete dimension D is at the wide end registering plane 1121. The narrowest part of the engaging elements 1112 (and the widest part of the receiving spaces 1114) along the discrete dimension D is at the narrow end registering plane 1120. A cap portion 1125 of an engaging element 1112 extends beyond the wide end registering plane. The receiving spaces 1114 are shaped correspondingly, with a space between the narrow end receiving plane and the body of the base 1123. (In order to simplify the figures, the box 1104 is shown with only one full engaging element per side, as well as a partial engaging element. In a typical implementation, there would be more, and perhaps many more, engaging elements per side. Further, the base has been shown of an unspecified, varying thickness, which is also possible, when the unit is molded unitarily, rather than being assembled from separate side pieces.) The boundary plane still bisects the portion of the engaging elements that are between the narrow end and the wide end registering planes. This extent of the engaging elements is referred to herein and in the claims as the "meshing height."

Each of the engaging elements are again characterized by a root portion 1126, and cantilevered therefrom, a flush ear 1124 and a butt ear 1122. Further, again, the engaging element 1115 that is closest to the virtual corner line 1108 is missing the flush ear portion 1124, and, typically for arrangements having a cap that extends beyond the wide end registering plane, a portion 1127 of the root portion 1126 as well. The reason for this is the same as discussed above, to provide for mating the construction members with other, similar construction members, and having translational symmetry along the discrete dimension, rotational symmetry, and the ability to assemble a network of four L-shaped units that are all adjacent a virtual corner line.

Figure 19:
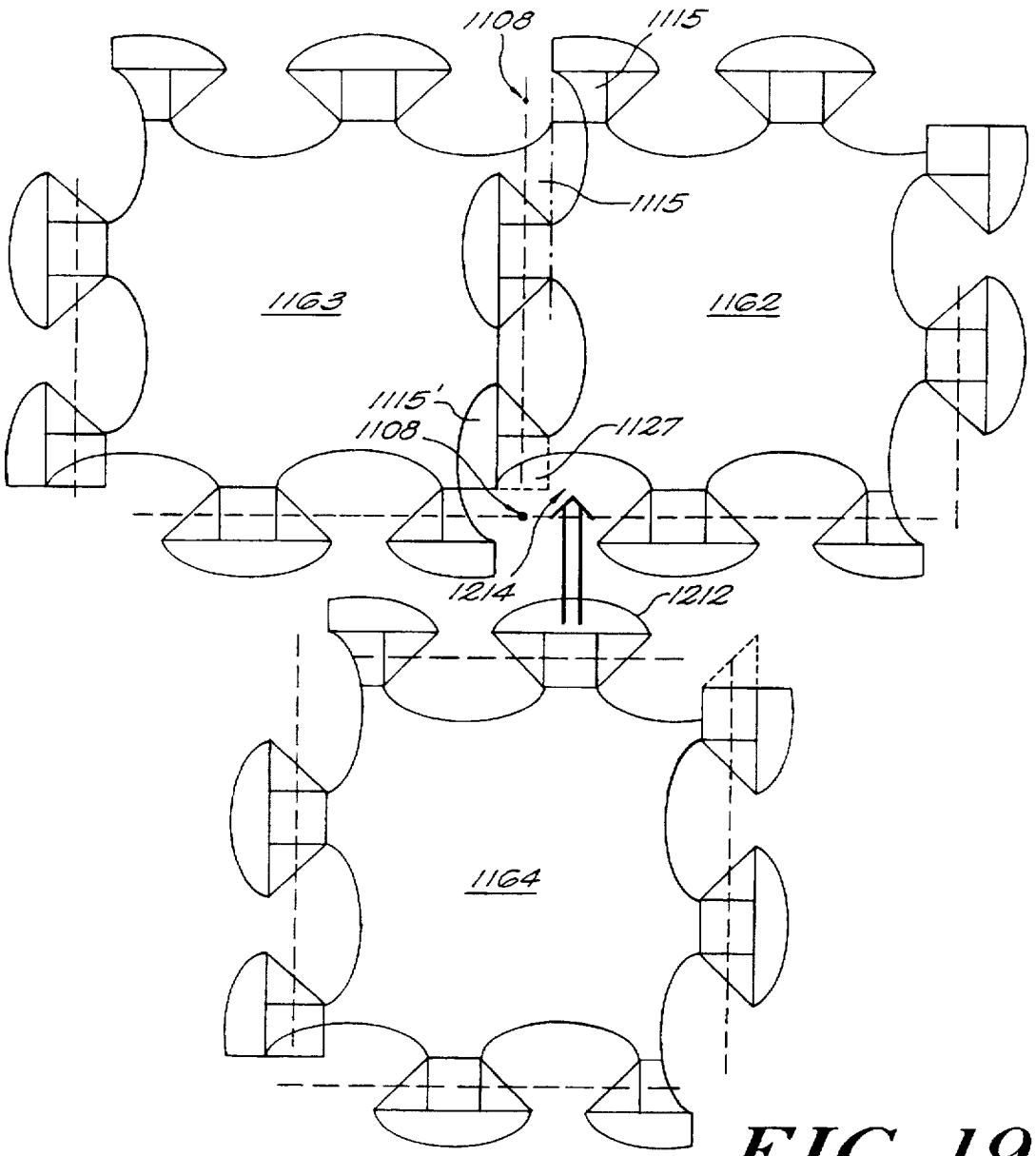
FIG. 19 shows schematically, in an end view, two boxes having generally mushroom shaped engaging elements meshed to each other, with a third about to be meshed to the first two, bridging between them.

This is shown schematically in FIG. 19, where two boxes 1162 and 1164, having mushroom shaped engaging elements and receiving spaces, are meshed. The two engaging elements 1115 are missing the flush ear portions, and a scooped out portion of their root portions. For the meshing shown between the boxes 1162 and 1163, it would only be required that the flush ear portions be missing. That shape would provide for the desired rotational symmetry.

However, the translational symmetry would not then be available, as can be seen with reference to the box 1164, that is shown about to be mated on the opposite face of the meshed boxes 1163, 1162, bridging the two. It can be seen that for the engaging element 1212 to be received in the space 1214 that is formed between the boxes 1162 and 1163, it is necessary that a part 1127 of the root portion of the engaging element 1115' that is closest to the virtual corner line 1108' be scooped out. If it is, then any other similarly shaped engaging element along the length of a construction member can be slidingly engaged into the space 1214, thus providing the desired translational symmetry.

Figure 20:
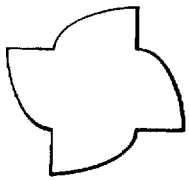
FIG. 20 shows schematically in an end view the empty space that is left between four L-shaped units that are mutually engaged to each other at a corner line.

The empty space that is formed at the intersection of four boxes having mushroom shaped engaging elements is a sort of spiral skewed star-shape, and is shown schematically in FIG. 20.

Figure 18:
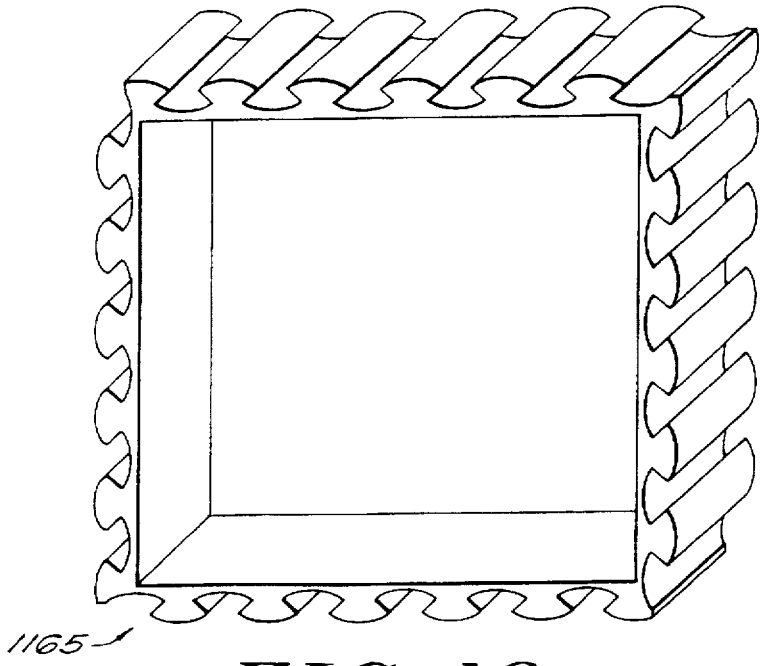
FIG. 18 shows schematically, in a perspective view a box having generally mushroom shaped engaging elements.

A schematic perspective view of a box 1165 that has mushroom shaped engaging elements and receiving spaces is shown in FIG. 18. Although the caps of the mushrooms are not themselves flat, a set of mushroom cap engaging elements do lie in a plane, and therefore do present a planar support surface for objects to be supported thereon, if the objects are large enough so that the surface appears to the object to be supported to be flat.

It will be evident to one of ordinary skill in the art that a pair of construction members, each having mushroom shaped receiving spaces, such as shown in FIG. 17, and dovetail shaped engaging elements, such as shown in FIG. 6, with the receiving spaces 1114 being wide enough to receive the dovetails, would mesh and provide all of the retention needed, despite the fact that the receiving spaces were not the same shape as the engaging elements. What is required is that they be the same cross-sectional sizes and shapes (with allowance for slidability and machining tolerances) over the extent of their meshing height, between the narrow 1120 and wide 1121 end registering planes, and that whatever additional cap portion 1125 of the engaging elements there are that extend beyond the wide end registering plane 1121 be small enough to fit within the portion of the receiving space that is between the narrow end registering plane 1120 and the body of the base 1123.

Figure 21A:
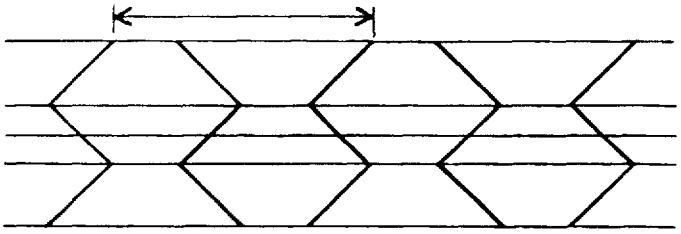
FIGS. 21A, 21B and 21C show schematically four different types of engaging elements and receiving spaces.
Figure 21B:
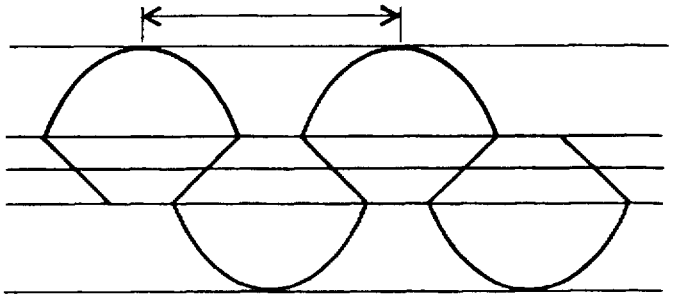
Figure 21C:
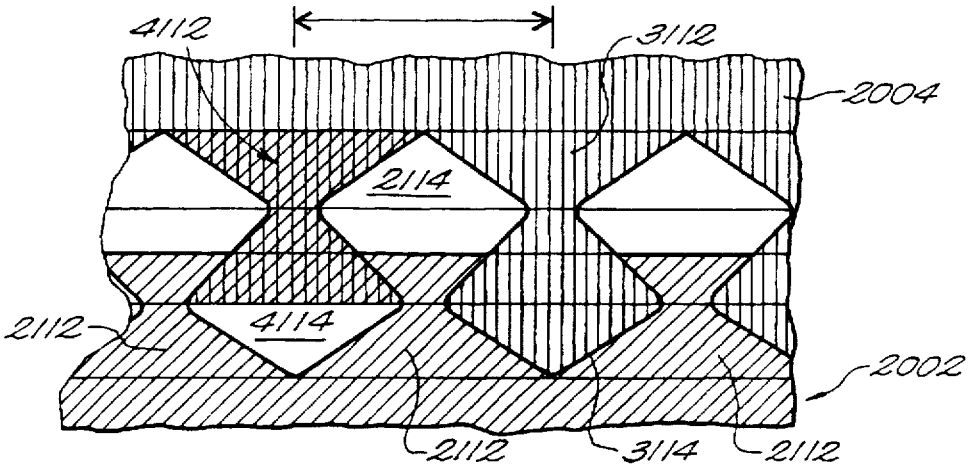

Some representative shapes that could also be used for the engaging elements and the receiving spaces are shown schematically in FIGS. 21A, 21B and 21C. It is emphasized that these shapes are shown as an illustration only, and not as a limitation. The general principals governing the shapes is discussed above. Using these different shapes provides a different aesthetic appearance, and may be desired in certain circumstances.

The foregoing examples and figures discussed have generally assumed that, for a pair of meshed construction members, the engaging elements of one member will have the same shape as those of the other member. This is not required for all embodiments of the invention. For instance, one member could have engaging elements with a cross-section that is an essentially truncated version of the cross-section of the engaging elements of the other member, and still many of the advantages of the invention would arise. For instance, as shown in FIG. 21C, the engaging elements of one member 2004 can be all fully represented, lobed shapes, such as shown as the engaging element 3112, (only one fully represented element is shown) while the engaging elements of the other member 2002 can be truncated versions thereof as shown at 2112. The receiving spaces 4114, 3114 of the member 2002 having the truncated engaging elements are also similarly truncated, because they are defined by the engaging elements 2112. In that case, the construction members 2004, 2002 are be restrained against separation, because both the fully represented 3112 and truncated 2112 engaging elements are restrained against separation by the portion of the receiving space that is narrower than wider portion of the respective engaging element, located in the direction of separation.

The construction members are further prevented from collapsing toward each other because the fully represented engaging elements 3112 of one of the construction members 2004 are blocked against motion toward the other construction member 2002 by the walls of the truncated receiving spaces in the other construction member 2002. This would also be the case even if the engaging elements of the construction member 2004 were not fully represented, but were, as shown at 4112, partially represented, but to a greater degree than the partial representation of the engaging elements 2112 on the partially represented construction member 2002. Still, the engaging element 4112 is prevented from traveling toward the construction member 2002 by the portion of the receiving space 4114 that is narrower than the wide portion of the engaging element 4112.

It will also be evident to one of skill in the art that if all of the receiving spaces were fully represented as shown, and all of the engaging elements were partially represented as shown at 2112, the two construction members would collapse toward each other.

The embodiment where the engaging elements of one construction member are larger in this fashion than those of the other is useful for the connection of two panels, and may also be used to connect a box, or U or L- shaped unit using the smaller engaging elements within a network of other units using the larger engaging elements. However, it is often not very useful if more than one unit having small engaging elements are to be used, because it tends to throw off the ability of associated boxes to be translated to any location desired.

Figure 12:
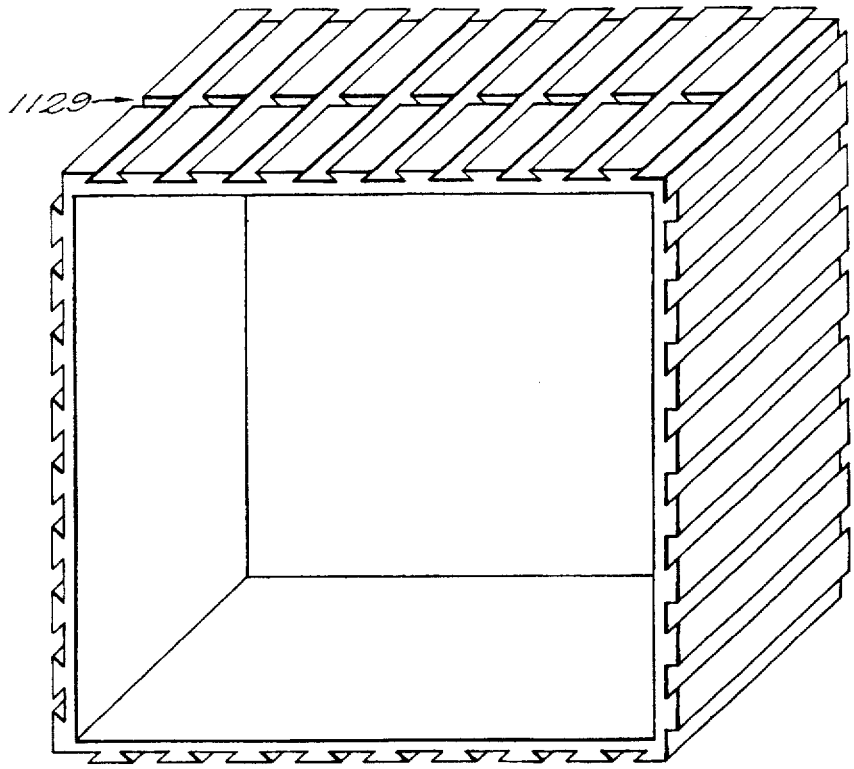
FIG. 12 shows schematically, in perspective view, a box such as is shown in FIG. 11.

It has been found to be convenient to taper the ends of the engaging elements, as shown on the right hand side of the box illustrated in FIG. 12, to facilitate the initial engagement of the elements by the receiving spaces.

The foregoing discussion has generally assumed that the engaging elements are continuous in the sliding dimension. This need not be so. They must present enough continuous length, either along one engaging element alone, or through an association of more than one engaging elements, so that a facing construction member can be meshed with it. Thus, there may be one or more gaps 1129 along the length of a construction element, such as to facilitate the engagement of a facing construction element, or the passage of other structures, such as electrical wires. An example is shown on the top surface of the box shown in FIG. 12.

The foregoing discussion has illustrated the invention with respect to individual construction members, or construction units that are made from two or more construction members joined to each other to form a right angle. As mentioned, rather than forming the construction units from individual planar members, the units can be molded unitarily in L-shapes, U-shapes and boxes.

Figure 22:
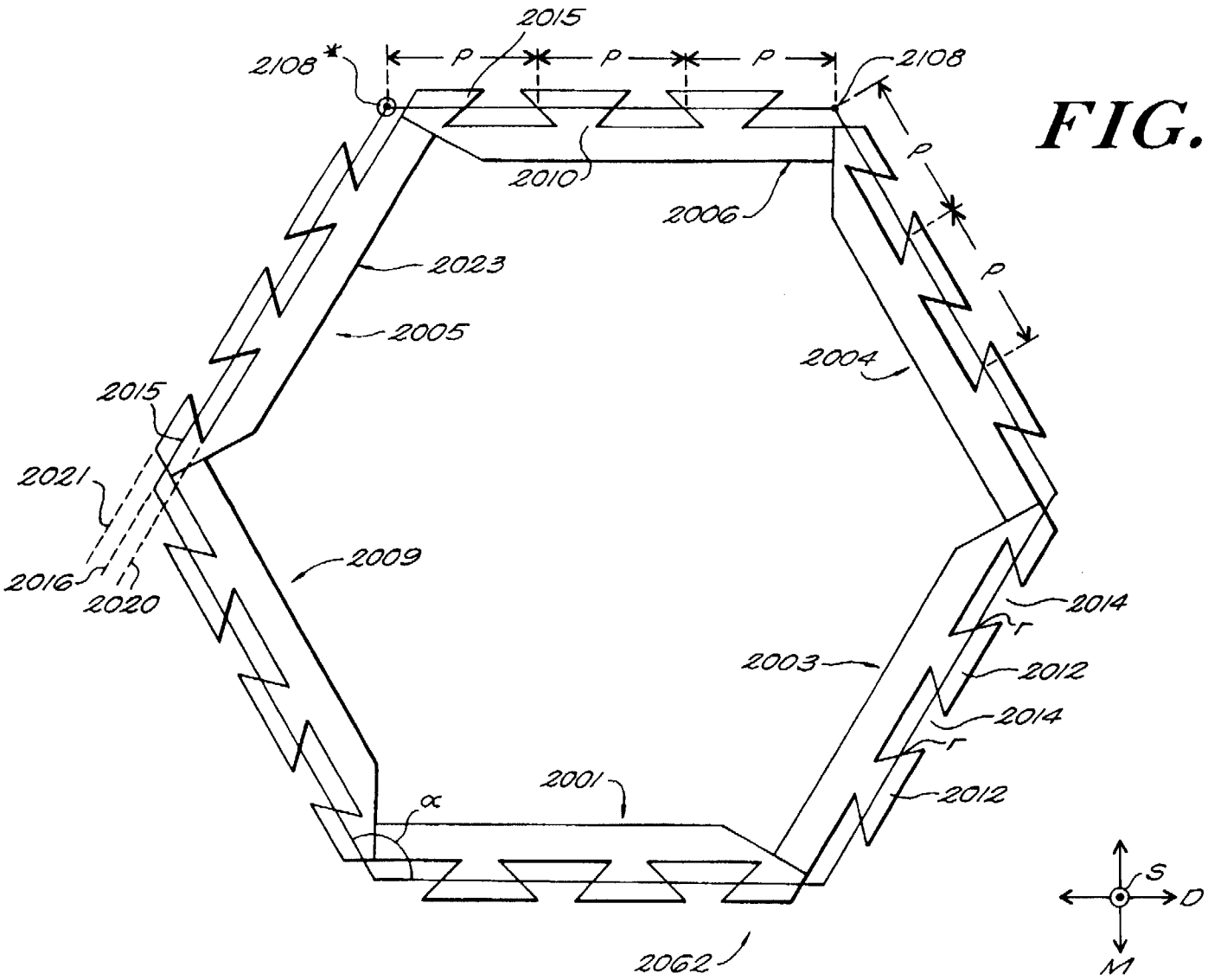
FIG. 22 is a schematic end view representation of a hexagonal embodiment of the invention.

The invention is also useful in connection with constructed units that include portions that are oriented with respect to each other at angles other than 90°. For instance, FIG. 22 shows six construction members arranged in a hexagon 2062. Each side of the hexagon is identical. To simplify the figure, various structures are only labeled on one or two sides. The construction members are basically the same as the construction members discussed above, having engaging elements 2012 with receiving spaces 2014 therebetween. The engaging elements also have reference points r, which are arranged an integral number of pitches P away from adjacent engaging element reference points, typically one P. Each reference point is located an integral number of pitches away from a virtual corner line 2018, which lies at the intersection of boundary planes 2016 for adjacent sides of the hexagon. One difference is that the boundary planes intersect each other at an included angle $\alpha$ of 120°, rather than 90°, as in the embodiments discussed above, for instance shown in FIG. 11. The boundary plane 2016 bisects the engaging elements and receiving spaces between a wide end registering plane 2021 and a narrow end registering plane 2020.

With respect to a virtual corner line, such as 2108*, one construction member 2006 may be considered the flush construction member, and the other 2005 may be considered the butt construction member, because the end of the butt construction member 2005 butts up against the obverse surface 2023 of the base 2010 of the flush construction member. Further end of the flush construction member 2006 is cut off at the engaging element 2015 that is closest to the virtual corner line such that the end is flush with the narrow end registering plane 2020 of the flush construction member 2005.

Figure 23:
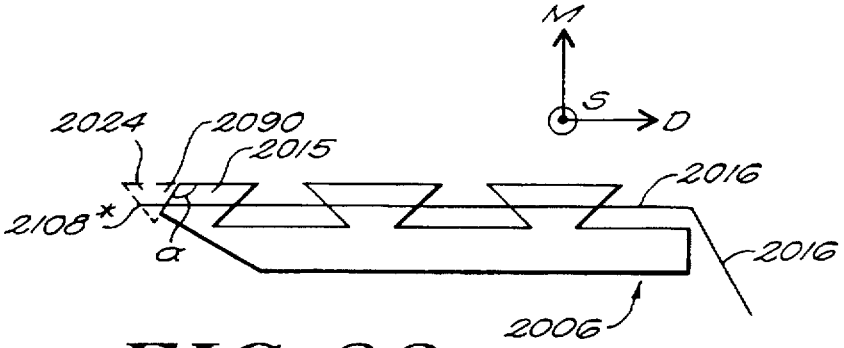
FIG. 23 is a schematic end view representation of a construction member of the invention that can be used to construct hexagonal units.

As shown in FIG. 23, which is a schematic end view of a construction member 2006 that can be used in a hexagon unit, the portion 2024 of the engaging element 2015 that would constitute the flush ear portion, is removed, along with a portion 2090 of the root section. The portion 2090 of the root portion is removed in order to accommodate the 120° angle $\alpha$ that is needed to enable the unit to fit with others, as described above in connection with the square units.

Figure 24:
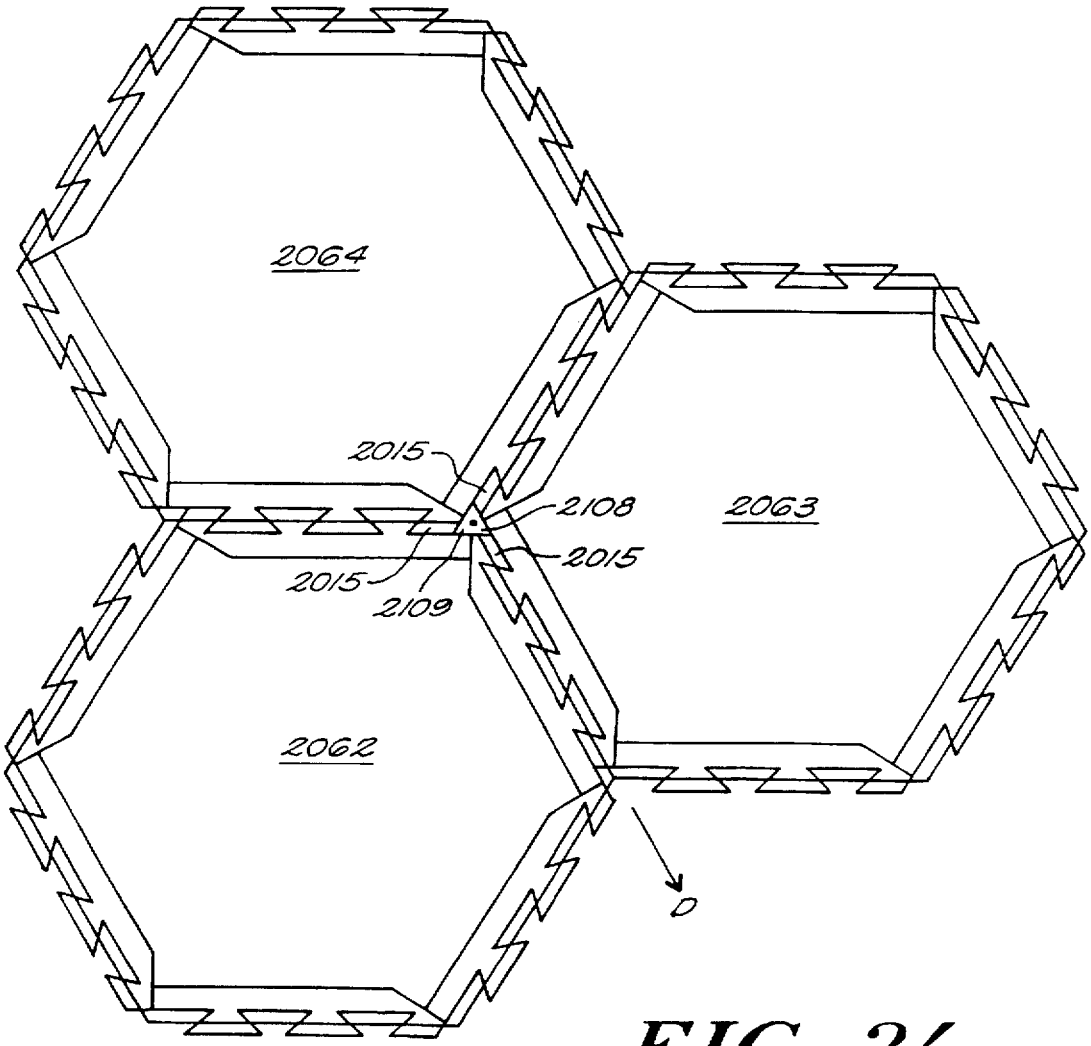
FIG. 24 is a schematic end view representation of three hexagonal units meshed together.

FIG. 24 shows schematically three hexagonal boxes, 2062, 2063, and 2064 mutually meshed with each other. The three hexagons share a virtual corner line 2108, which lies in a triangular shaped empty space 2109 between the three boxes. It can be seen from inspection of the figure that the 120° cut-off of the corner engaging elements 2015 allows the three boxes to meet, and also allows them to be rearranged with respect to each other, with one translated relative to the other along their mutual discrete dimension. For instance, the box 2063 could be removed and reengaged with the box 2062 only, one engaging element downward along the discrete dimension D that is shared by the boxes 2063 and 2062.

The shape of the construction members at their ends (other than the shape of the engaging element) is somewhat arbitrary: both must be mutually shaped so that they can be joined with the engaging elements as illustrated.

Rather than constructing an entire, closed hexagon, any portion including from two to six sides can be constructed.

As with the embodiments discussed above, a practical way to manufacture these hexagonal units may be to mold them unitarily, rather than to connect together individual construction members. In such a case, there would be no seams, and there would be no concern over the shapes at the ends of any construction members.

As with the embodiments described above, the engaging elements need not be dovetails. The same considerations for their shapes as discussed above applies in the non rectangular parallelepiped case.

It will be understood by one of ordinary skill in the art that the invention can also be used with units having shapes other than hexagons. All regular polyhedral shapes can be used, including triangles, pentagons, etc., as well as mixtures, such as appear on soccer balls of hexagons and pentagons. The general principals are that the engaging element reference points be located an integral number of pitches away from virtual corner lines, which lie at the intersection of virtual boundary lines that bisect the engaging elements. The corner engaging elements should be either missing entirely, or should be missing so much of the flush ear portion and any adjacent root portion as is necessary, to allow a flush line from the engaging element to the narrow end registering plane of the adjacent side of the unit.

Within limits, various shapes can be associated together in a network. For instance, the network of boxes and open sided units can include rectangles, hexagons, triangles, right angle L's, 120° angle spread open L's, etc. However, the packability of the units in such a case will not be as compact as where all of the shapes are of the same type.

It is believed that any shape, from a triangle up to a many sided shape approaching a circle could theoretically be constructed according to the principals outlined above. For a triangle, isosceles triangles having angles as small as 45° and equilateral triangles having angles of 60° can be used. Thus, the angle between any two sides or construction members of a constructed unit can range between 45° and an upper limit that depends on the number of sides. For a six sided shape, the angle between sides is 120°, for a twelve sided shape, the angle between sides is 150°. One of ordinary skill in the art will understand the principals that establish this angle.

Figure 33:
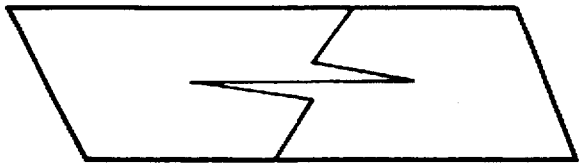
FIG. 33 is a schematic representation of a mated pair of engaging elements that are not symmetric about a midline.

The examples discussed above have used engaging elements that are symmetric about a midplane that is perpendicular to the cross-section cutting plane. This is typically the most useful case. However, that is not absolutely required. For instance, one face of the engaging element, for instance, its butt edge, could be in a sawtooth pattern that would mate with a similarly sawtoothed engaging element of a mating construction member. An exagerrated version of this is shown in FIG. 33. Similarly, the flush edge could have a similarly non-linear shape. This might result in the reference point of an engaging element actually lying in the space that is slightly outside of the cross-section of the engaging element. Such a case would arise if the engaging element edge jogs at the midpoint between the narrow end registering plane and the wide end registering plane. Such embodiments are also within the contemplation of the invention.

Figure 34:
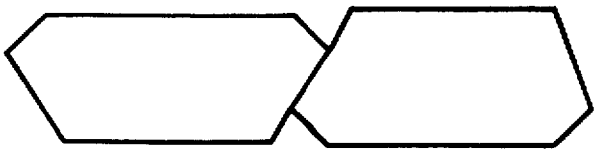
FIGS. 34 and 35 are schematic representations of a mated pair of engaging elements that have been formed from dovetails, with portions removed.
Figure 35:
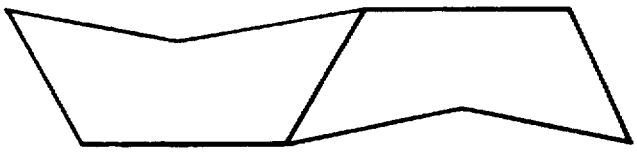

Further, it is possible to remove portions of a standard dovetail, such as is shown in FIG. 34, where the corners are clipped off, or FIG. 35, where the long dimensions are scooped out, and still have the engaging elements mate with each other, retain the two mated construction members againgst motion in the meshing and discrete dimensions, and also be combined in units such as L-shapes and boxes with the translational and rotational symmetries discussed above. These embodiments are also within the contemplation of the invention.

It should also be noted that the function of an engaging element can be performed by two separate, spaced apart structures, such as for instance if a slice were taken from the root portion of a conventional dovetail engaging element, leaving a flush and a butt ear portion, each of which are attached to the base by a small, but sufficiently strong sliver of the root. As used herein, the phrase "engaging element" also is meant to cover such a two piece structure.

Thus, it will be readily understood that the disclosed embodiments of the invention satisfy all of the goals of the invention, either together or separately. A user can easily associate one or more units made from the construction member of the invention, into a network of storage, display spaces and apparatus that can be customized to a great degree. Once constructed, the network is relatively secure against disengagement, due to the large number of interlocking surfaces, and any detent, or surface treatments provided for that purpose. However, the user can readily change the configuration of the storage units if it does not suit his/her needs, or if those needs change.

The construction members can be relatively easily and economically made using conventional molding techniques if made from plastic material, or other machining techniques if made from wood, metal, or composite materials. They can be made to have attractive colors and interesting and attractive surface presentations. They can easily be incorporated into the architecture of computer equipment cases, office work cubicles, kitchens, work areas, schools, retail sales displays, etc.

Other uses can be made of the cross-sectional shape of a box, such as is shown in FIG. 11, which provides the described rotational and translational symmetry. Rather than hollow boxes, units of mats, such as rubber floor mats, can be made with this cross-section. Using such floor mats, one can cover a work or play space with the pieces as desired. Further, the pieces can be rotated, or translated relative to each other. If the unit size side embodiment is used, flooring can be made to cover a space, using different size pieces. Thus, a child's play space could be covered with different colored and sized mat pieces. The children or adult supervisors could easily remove one or more pieces, substitute others for that piece, rotate the piece, offset sections from one another and insert additional sections. This is ideal for the play of children.

Similarly, floor coverings using the shapes described above can be used for decorative purposes, using any appropriate medium, including but not limited to linoleum, ceramic tile, rubber, stone, brick, wood, etc.

Further, as mentioned above, the boxes and other units (L-shapes, U-shapes, planar panels) can be constructed as children's toys, like building blocks and Lego™ brand play blocks.

Such embodiments other than the work space organizational embodiment discussed initially are contemplated as part of the invention.

The foregoing discussion should be understood as illustrative and should not be considered to be limiting in any sense. While this invention has been particularly shown and described with references to preferred embodiments thereof, it will be understood by those skilled in the art that various changes in form and details may be made therein without departing from the spirit and scope of the invention as defined by the claims.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, any means-plus-function clauses are intended to cover the structures described herein as performing the recited function and not only structural equivalents but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

Having described the invention, what is claimed is:

1. First and second construction members, comprising:

a. a first construction member comprising:

i. a base having an engaging element side and an obverse side; and ii. extending from said engaging element side along a meshing dimension, at least three engaging elements that are spaced apart along a discrete dimension that is perpendicular to said meshing dimension, and that extend along a sliding dimension that is perpendicular to both said discrete and said meshing dimensions;

A. each of said engaging elements having a cross-section as cut by a cutting plane in which lie both of said discrete and meshing dimensions, which cross-section has a relatively narrow width along said discrete dimension at a narrow end registering plane that is relatively close to said base, and a relatively wide width along said discrete dimension at a wide end registering plane that is relatively distant from said base;

B. each engaging element having a reference point, said engaging elements being spaced such that said reference point on each engaging element is spaced an integral number of pitches (P) from said reference point of any adjacent engaging element; and C. each pair of adjacent engaging elements defining therebetween, a receiving space, at least two of which have a cross-sectional shape and area cut by said cutting plane that is substantially congruent with so much of said cross-sectional shape of said engaging elements as lies between said wide end registering plane and said narrow end registering plane, and large enough so that an engaging element of a second construction member that is substantially identical with one of said engaging elements of said first construction member is slidably engageable with said receiving space, and also small enough so that said second construction member, slideably engaged, is substantially restrained against motion along said meshing and discrete dimensions relative to said first construction member; and b. a second of said construction members, connected to said first construction member with said meshing dimensions of each construction member being inclined relative to each other, and said sliding dimensions of each construction member being parallel;

c. said reference point of each of said engaging elements of both said first and second construction members further being located an integral number of pitches away from a first virtual corner line that:

i. is spaced away from a flush end of said first construction member along said discrete dimension of said first construction member;

ii. is spaced away from a butt end of said second construction member along said discrete dimension of said second construction member;

iii. is parallel to said sliding dimensions of both said first and second construction members; and iv. lies at the intersection of a first boundary plane that includes said reference point for each of said engaging elements of said first construction member and a second boundary plane that includes said reference point for each of said engaging elements of said second construction member.

2. The construction members of claim 1, said spacing between said reference points of adjacent engaging elements being equal to one pitch (P).

3. The construction members of claim 1, said engaging elements having a cross-sectional shape of a dovetail.

4. The construction members of claim 1, said receiving spaces having a cross-sectional shape of a dovetail.

5. The construction members of claim 1, said engaging elements and receiving spaces being elongated along said sliding dimension.

6. The construction members of claim 1, said base comprising a planar member.

7. The construction members of claim 1, further comprising a third of said construction members, connected to said second construction member, with:

a. said meshing dimensions of said second and third construction members being perpendicular;

b. said sliding dimensions of each construction member being parallel; and c. said engaging elements of said first and third construction members facing away from each other.

8. The construction members of claim 7, further comprising a fourth of said construction members, connected to said third construction member with:

a. said meshing dimensions of said third and fourth construction members being perpendicular;

b. said sliding dimensions of each construction member being parallel; and c. said engaging elements of said second and said fourth construction members facing away from each other.

9. The construction members of claim 8, said second and fourth of said construction members having a length along their respective discrete dimensions that are equal, and said first and third of said construction members having a length along their respective discrete dimensions that are equal.

10. The construction members of claim 9, said first and second of said construction members having a length along their respective discrete dimensions that are equal.

11. The construction members of claim 9, said first and second of said construction members having a length along their respective discrete dimensions that are different.

12. The construction members of claim 1, said engaging elements having a mushroom shaped cross-section.

13. The construction members of claim 1, said receiving spaces having a mushroom shaped cross-section.

14. The construction members of claim 1, the number of pitches of said spacing between reference points of at least one pair of said engaging elements that are adjacent being different from the number of pitches of said spacing between reference points of at least one other pair of adjacent engaging elements.

15. The construction members of claim 1, said reference point of each said engaging element of said first construction member being located an integral number of pitches away from a second virtual corner line that:

a. is spaced away from a butt end of said first construction member at the opposite end of said first construction member from said flush end, along said discrete dimension;

b. is parallel to said first virtual corner line; and c. also lies in said boundary plane.

16. The construction members of claim 1:

a. said reference point of each said engaging element of said first construction member further being located an integral number of pitches away from a second virtual corner line that:

i. is spaced away from a butt end of said first construction member at the opposite end of said first construction member from said flush end, along said discrete dimension of said first construction member;

ii. is parallel to said first virtual corner line; and iii. lies in said first boundary plane; and b. said reference point of each said engaging element of said second construction member further being located an integral number of pitches away from a third virtual corner line that:

i. is spaced away from a flush end of said second construction member at the opposite end of said second construction member from said butt end, along said discrete dimension of said second construction member;

ii. is parallel to said first virtual corner line; and iii. lies in said second boundary plane.

17. The construction members of claim 16, further comprising a third and a fourth construction member, connected to each other in substantially the identical manner as are said first and second construction members, respectively:

a. said third construction member being connected to said second construction member with:

i. said third virtual corner line being spaced away from a butt end of said third construction member;

ii. said reference points of said engaging elements of said third construction member being each located an integral number of pitches away from said third virtual corner line; and iii. a third boundary plane including said third virtual corner line and said reference point for each of said engaging elements of said third construction member; and b. said fourth construction member is connected to said first construction member, with:

i. said second virtual corner line being spaced away from a flush end of said fourth construction member;

ii. said reference points of said engaging elements of said fourth construction member being each located an integral number of pitches away from said second virtual corner line; and iii. a fourth boundary plane including said second virtual corner line and said reference point for each of said engaging elements of said fourth construction member.

18. The construction members of claim 16, further comprising a third construction member, connected to said second construction member with:

a. said third virtual corner line being spaced away from a butt end of said third construction member;

b. said reference points of said engaging elements of said third construction member being each located an integral number of pitches away from said third virtual corner line; and c. a third boundary plane including said third virtual corner line and said reference point for each of said engaging elements of said third construction member.

19. The construction members of claim 1, said engaging elements further arranged with no engaging element that has a full representation of said cross-section having its reference point located closer to said first virtual corner line than one pitch (P).

20. The construction members of claim 1, said engaging elements further arranged with no part of said first construction member being closer to said first virtual corner line than one half the distance between said narrow end registering plane and said wide end registering plane of said first construction member.

21. The construction members of claim 20, further comprising a corner engaging element that:

a. is adjacent said flush end of said first construction member;

b. has a cross-section that is the same size and shape as a portion of said cross-section of said engaging elements, and c. is spaced from said virtual corner line such that, if its cross-section were the same size and shape as said cross-section of said engaging elements, its reference point would lie on said virtual corner line.

22. The construction members of claim 16, said engaging elements further arranged with no engaging element that has a full representation of said cross-section having its reference point located closer to said first virtual corner line than one pitch (P).

23. The construction members of claim 17, said engaging elements further arranged with no part of any of said first, second, third or fourth construction member being closer to said first, third, fourth or second virtual corner lines respectively, than one half the distance between said narrow end registering plane and said wide end registering plane.

24. The construction members of claim 23, said first, second, third and fourth construction members further each comprising a corner engaging element that:

a. is adjacent said flush end of said respective construction member;

b. has a cross-section that is the same size and shape as a portion of said cross-section of said engaging elements, and c. is spaced from said first, third, fourth and second virtual corner lines, respectively, such that, if its cross-section were the same size and shape as said cross-section of said engaging elements, its reference point would lie on said respective virtual corner line.

25. The construction members of claim 17, said engaging elements further arranged with no engaging element that has a full representation of said cross-section having its reference point located closer to any of said virtual corner lines than one pitch (P).

26. The construction members of claim 1, said second of said construction members being connected to said first construction member with said meshing dimensions of each construction member being at an angle $\alpha$ of between 45° and 150° to each other and said sliding dimensions of each construction member being parallel.

27. The construction members of claim 26, said reference point of each of said engaging elements of both said first and second construction members further being located an integral number of pitches away from a first virtual corner line that:

a. is spaced away from a flush end of said first construction member along said discrete dimension of said first construction member;

b. is spaced away from a butt end of said second construction member along said discrete dimension of said second construction member;

c. is parallel to said sliding dimensions of both said first and second construction members; and d. lies at the intersection of a first boundary plane that includes said reference point for each of said engaging elements of said first construction member and a second boundary plane that includes said reference point for each of said engaging elements of said second construction member.

28. The construction members of claim 26, said second of said construction members, connected to said first construction member such that said meshing dimensions of each construction member are at an angle a of approximately 120° to each other and said sliding dimensions of each construction member are parallel.

29. A first construction unit, said first construction unit comprising:

a. a first base having an engaging element side; and b. extending from said engaging element side along a first meshing dimension, a first set of at least three engaging elements that are spaced apart along a first discrete dimension that is perpendicular to said first meshing dimension, and that extend along a first sliding dimension that is perpendicular to both said first discrete and said first meshing dimensions;

i. each of said engaging elements having a cross-section as cut by a cutting plane in which lie both of said first discrete and first meshing dimensions, which cross-section has a relatively narrow width along said first discrete dimension at a first narrow end registering plane that is relatively close to said first base, and a relatively wide width along said first discrete dimension at a first wide end registering plane that is relatively distant from said base;

ii. each engaging element having a reference point, said engaging elements being spaced with said reference point on each engaging element being spaced an integral number of pitches (P) from said reference point of any adjacent engaging element; and iii. each pair of adjacent engaging elements defining therebetween, a receiving space, at least two of which have a cross-sectional shape and area cut by said cutting plane that is substantially congruent with so much of said cross-sectional shape of said engaging elements as lies between said first wide end registering plane and said first narrow end registering plane, and large enough so that an engaging element of a second construction unit that is substantially identical with one of said engaging elements of said first construction unit is slidably engageable with said receiving space, and also small enough so that said second construction unit, slideably engaged, is substantially restrained against motion along said first meshing and first discrete dimensions relative to said first construction unit;

c. connected to said first base, a second base having an engaging element side;

d. extending from said second base engaging element side along a second meshing dimension, a second set of at least three engaging elements that are spaced apart along a second discrete dimension that is perpendicular to said second meshing dimension, that is inclined at an angle ($\alpha$) relative to said first discrete dimension, and that extend along said first sliding dimension that is perpendicular to both said second discrete and said second meshing dimensions;

i. each of said second set of engaging elements having a cross-section as cut by said cutting plane in which lie both of said second discrete and second meshing dimensions, which cross-section has a relatively narrow width along said second discrete dimension at a second narrow end registering plane that is relatively close to said second base, and a relatively wide width along said second discrete dimension at a second wide end registering plane that is relatively distant from said second base;

ii. each engaging element of said second set having a reference point, said engaging elements of said second set being spaced with said reference point on each engaging element being spaced an integral number of pitches (P) from said reference point of any adjacent engaging element; and iii. each pair of adjacent engaging elements of said second set defining therebetween, a receiving space, at least two of which have a cross-sectional shape and area cut by said cutting plane that is substantially congruent with so much of said cross-sectional shape of said engaging elements of said second set as lies between said second wide end registering plane and said second narrow end registering plane, and large enough so that an engaging element of said second construction unit is slidably engageable with said receiving space, and also small enough so that said second construction unit, slideably engaged, is substantially restrained against motion along said second meshing and second discrete dimensions relative to said first construction unit; and e. said reference point of each of said engaging elements of both said first and second sets of engaging elements further being located an integral number of pitches away from a first virtual corner line that:

i. is spaced away from a flush end of said first base along said first discrete dimension;

ii. is spaced away from a butt end of said second base along said second discrete dimension;

iii. is parallel to said sliding dimension; and iv. lies at the intersection of a first boundary plane that includes said reference point for each of said first set of engaging elements and a second boundary plane that includes said reference point for each of said second set of engaging elements.

30. The construction unit of claim 29:

a. said reference point of each said first set of engaging elements further being located an integral number of pitches away from a second virtual corner line that:

i. is spaced away from a butt end of said first base at the opposite end of said first base from said flush end, along said first discrete dimension;

ii. is parallel to said first virtual corner line; and iii. lies in said first boundary plane; and b. said reference point of each said second set of engaging elements further being located an integral number of pitches away from a third virtual corner line that:

i. is spaced away from a flush end of said second base at the opposite end of said second base from said butt end, along said second discrete dimension;

ii. is parallel to said first virtual corner line; and iii. lies in said second boundary plane.

31. The construction unit of claim 30, said first set of engaging elements further arranged with no part of said first base and first set of engaging elements being closer to said first virtual corner line than one half the distance between said narrow end registering plane and said wide end registering plane.

32. The construction unit of claim 31, said first construction unit further comprising a corner engaging element that:

a. is adjacent said flush end of said first base;

b. has a cross-section that is the same size and shape as a portion of said cross-section of said first set of engaging elements, and c. is spaced from said first virtual corner line such that, if its cross-section were the same size and shape as said cross-section of said first set of engaging elements, its reference point would lie on said first virtual corner line.

33. The construction unit of claim 30, said first set of engaging elements further arranged with no engaging element that has a full representation of said cross-section having its reference point located closer to said first virtual corner line than one pitch (P).

34. The construction unit of claim 29, said connection between said first and second construction members comprising a molded connection that is unitary with both of said first and second construction members.

35. The construction unit of claim 29, said first and second construction members being separately formed, said connection between said first and second construction members comprising a seam connection that joins said first and second construction members.

36. First and second construction members, comprising:

a. a first construction member comprising:

i. a base; and ii. extending from one side along a meshing dimension, at least three engaging elements that are spaced apart along a discrete dimension that is perpendicular to said meshing dimension, and that extend along a sliding dimension that is perpendicular to both said discrete and said meshing dimensions;

A. each of said engaging elements being sized and shaped such that it is slideably engageable along said sliding dimension with a receiving space between engaging elements of a substantially identical second construction member, and such that so engaged, said second construction member is restrained against motion along said discrete and meshing dimensions relative to said first construction member; and B. said engaging elements being spaced apart from each other, with a reference point on each engaging element being spaced an integral number of pitches (P) from the reference point on any adjacent engaging element;

b. a second of said construction members, connected to said first construction member with said meshing dimensions of each construction member being inclined relative to each other, and said sliding dimensions of each construction member being parallel; and c. said reference point of each of said engaging elements of both said first and second construction members further being located an integral number of pitches away from a first virtual corner line that:

i. is spaced away from a flush end of said first construction member along said discrete dimension of said first construction member;

ii. is spaced away from a butt end of said second construction member along said discrete dimension of said second construction member;

iii. is parallel to said sliding dimensions of both said first and second construction members; and iv. lies at the intersection of a first boundary plane that includes said reference point for each of said engaging elements of said first construction member and a second boundary plane that includes said reference point for each of said engaging elements of said second construction member.

37. An office equipment case carrying on a surface thereof, first and second construction members, comprising:

a. a first construction member for detachable engagement with another, substantially identical construction member, said first construction member comprising:

i. a base that is connected to said equipment case; and ii. extending from said base away from said equipment case along a meshing dimension, at least three engaging elements that are spaced apart along a discrete dimension that is perpendicular to said meshing dimension, said engaging elements extending along a sliding dimension that is perpendicular to both said discrete and said meshing dimensions;

A. each of said engaging elements being sized and shaped such that it is slideably engageable along said sliding dimension with a receiving space between engaging elements of a substantially identical second construction member, and such that so engaged, said second construction member is restrained against motion along said discrete and meshing dimensions relative to said case; and B. said engaging elements being spaced apart from each other with a reference point on each engaging element being spaced an integral number of pitches (P) from the reference point on any adjacent engaging element;

b. a second of said construction members, connected to said first construction member with said meshing dimensions of each construction member being inclined relative to each other and said sliding dimensions of each construction member being parallel; and c. said reference point of each of said engaging elements of both said first and second construction members further being located an integral number of pitches away from a first virtual corner line that:

i. is spaced away from a flush end of said first construction member along said discrete dimension of said first construction member;

ii. is spaced away from a butt end of said second construction member along said discrete dimension of said second construction member;

iii. is parallel to said sliding dimensions of both said first and second construction members; and iv. lies at the intersection of a first boundary plane that includes said reference point for each of said engaging elements of said first construction member and a second boundary plane that includes said reference point for each of said engaging elements of said second construction member.

38. A construction member for forming an L-shaped unit that is detachably engageable with a first construction member, said L-shaped unit of construction members comprising second and third planar construction members that are substantially identical to said first construction member; wherein a. said first planar construction member is oriented with respect to a boundary plane that extends between a flush and a parallel butt virtual corner line, said first construction member comprising:

i. a base:

A. having a narrow end registering plane that is spaced from and substantially parallel to said boundary plane;

B. having a second surface, obverse of said narrow end registering plane;

C. having a discrete dimension that is perpendicular to said flush and butt virtual corner lines;

D. having a sliding dimension, perpendicular to said discrete dimension, such that a plane including said discrete and sliding dimensions is parallel with said narrow end registering plane; and E. having a butt edge and a flush edge, spaced apart along said discrete dimension, with both said flush and butt edges being spaced from and between said flush and butt virtual corner lines, with said flush edge between said flush virtual corner and said butt edge; and ii. extending from said narrow end registering plane away from said base, along a meshing dimension that is perpendicular to both said sliding and discrete dimensions, a plurality of engaging elements, spaced apart along said discrete dimension:

A. each of said engaging elements having:

I. a reference point that is identically located along said discrete dimension;

II. a butt edge and a flush edge, said butt edge of said engaging element lying between said butt edge of said construction member and said flush edge of said engaging element; and III. along said discrete dimension, a substantially identical cross-section as cut by a cutting plane that includes said meshing dimension and said discrete dimension;

B. said spacing between corresponding reference points on each of a successive pair of engaging elements, being equal, said spacing being defined as the "pitch," (p), of said engaging elements;

C. a space formed between any pair of said engaging elements, designated a "receiving space," having a cross-section, as cut by said cutting plane, that is substantially identical to the cross-section of any other receiving space between any other pair of said engaging elements; and D. said cross-sectional size and shapes of each said engaging element and each said receiving space being configured such that said second construction member:

I. is slideably engageable along said sliding dimension of said first construction member, with said engaging elements of said second construction member slidable into and occupying said receiving spaces of said first construction member;

II. if joined to said first construction member by said engaging elements of said second construction member occupying said receiving spaces of said first construction member, is secured against relative motion along said discrete dimension of said first construction member and along said meshing dimension of said first construction member; and III. any engaging element of said second construction member is engageable in any receiving space of said first construction member;

b. said second and third construction members, having engaging elements and receiving spaces with substantially the same size and shape cross-section as said first construction member and substantially the same spatial relationships among said reference point, butt end and flush end of said construction member and said engaging elements, said third construction member being joined to said second construction member, with said butt end of said third construction member butt up against the obverse surface of said second construction member, with said flush end of said second construction member being flush with said narrow end registering plane of said third construction member and said boundary planes of said second and third construction members being inclined relative to each other and intersecting at said flush virtual corner line of said second construction member and said butt virtual corner line of said third construction member, which are coincident, said joined second and third construction members designated an "L-shaped unit"; and c. said reference point of each of said second and third construction member engaging elements being spaced from said respective flush and butt virtual corner lines an integral number of pitches.

39. The construction member of claim 38, said engaging elements being located and said cross-sectional size and shapes of each said engaging element and each said receiving space being further configured such that each of said second and third construction members, in said configuration joined to each other:

a. are separately slideably engageable along said sliding dimension of said first construction member, with said engaging elements of said respective second or said third construction members slidable into and occupying said receiving spaces of said first construction member; and b. if joined to said first construction member by said engaging elements of said respective second and third construction members occupying said receiving spaces of said first construction member, is secured against relative motion along said discrete dimension of said first construction element and along said meshing dimension of said first construction member; and c. any engaging element of said second and third construction member is engageable in any receiving space of said first construction member.

40. The construction member of claim 38, said cross-section of said engaging elements comprising:

a. a neck portion adjacent said base, said neck portion having a zone with a narrowest width along said discrete dimension; and b. more distant from said base than said neck, a head portion, said head having a zone with a widest width along said discrete dimension that is greater than said narrowest width of said neck.

41. The construction member of claim 38, said cross-section of said engaging elements comprising a dovetail.

42. The construction members of claim 40, said reference point comprising the midpoint of a line joining the flush edge of said narrowest zone of said neck portion with the flush edge of said widest zone of said head portion.

43. The construction member of claim 42, said boundary plane located such that it includes said reference point of each engaging element.

44. The construction member of claim 40, said boundary plane located such that it bisects said engaging elements between said narrowest zone of said neck and said widest zone of said head.

45. The construction member of claim 38, further said extent along said sliding dimension being such that it is substantially larger than said extent of said engaging elements along said meshing dimension.

46. The construction member of claim 38, further comprising a fourth of said construction embers, having engaging elements and receiving spaces with substantially the same size and shape cross-section as said first construction member, and substantially the same spatial relationships among said reference point, butt end and flush end of said fourth construction member and said engaging elements, joined to said third construction member, with said butt end of said fourth construction member butt up against the obverse surface of said third construction member, with said flush end of said third construction member being flush with said narrow end registering plane of said fourth construction member and said boundary planes of said third and fourth construction members being perpendicular and intersecting at said flush virtual corner line of said third construction member and said butt virtual corner line of said fourth construction member.

47. The construction members of claim 46, further comprising a fifth of said construction members, having engaging elements and receiving spaces with substantially the same size and shape cross-section as said first construction member, and substantially the same spatial relationships among said reference point, butt end and flush end of said construction element and said engaging elements, joined to said fourth and second construction members, with said butt end of said fifth construction member butt up against the obverse surface of said fourth construction member, with said flush end of said fourth construction member being flush with said narrow end registering plane of said fifth construction member and with said butt end of said second construction member being butt up against the obverse surface of said fifth construction member, with said flush end of said fifth construction member being flush with said narrow end registering plane of said second construction member and said boundary planes of said fourth and fifth construction members being perpendicular and intersecting at said flush virtual corner line of said fourth construction member and said butt virtual corner line of said fifth construction member and said boundary planes of said fifth and second construction members being perpendicular and intersecting at said flush virtual corner line of said fifth construction member and said butt virtual corner line of said first construction member, thereby forming a four sided box.

48. The construction member of claim 38, further comprising a second L-shaped unit comprising second and third construction members, substantially identical to said first L-shaped unit, said engaging elements being sized and shaped, and said reference point located relative to said respective flush virtual corner lines and said butt virtual corner lines, such that if said second construction member of said first L-shaped unit is slideably engaged with said third construction member of said second L-shaped unit such that said narrow end registering planes of said third construction member of said first L-shaped unit and said second construction member of said second L-shaped unit are coplanar, a continuous narrow end registering plane is formed, from which extend engaging elements substantially arranged along said discrete dimension of said third construction member of said first L-shaped unit so that a bridging construction member, substantially identical to said second construction member of said first L-shaped unit, is simultaneously slideably engageable along said sliding dimension of said coplanar narrow end registering planes of said second and first L-shaped units.

49. The construction member of claim 48, said engaging elements further being spaced relative to said respective flush virtual corner lines and butt virtual corner lines such that any engaging element of said bridging construction member is engageable in the receiving space between any two engaging elements extending from said coplanar engaging planes of said first and second L-shaped units.

50. The construction member of claim 38, further comprising a fourth construction member, connected to said, third construction member in the same manner and relative configuration as said third construction member is connected to said second construction member.

51. The construction member of claims 50, further comprising a fifth construction member, connected to said fourth construction member in the same manner and relative configuration as said third construction member is connected to said second construction member.

52. The construction member of claimed 51, further wherein said second construction member is connected to said fifth construction member in the same manner and relative configuration as said third construction member is connected to said second construction member, forming a right parallelepiped.

53. The construction member of claim 47, said second and fourth construction members being sized such that they are the same length along said respective discrete dimension as each other, and said third and fifth construction members being sized such that they are the same length along said respective discrete dimension as each other, wherein said box has a rectangular cross-section if cut by said cutting plane.

54. The construction member of claim 53, said second and third construction members being sized such that they are the same length along said respective discrete dimension as each other, wherein said box has a square cross-section.

55. The construction member of claim 53, the length of said second construction member along said discrete dimension being sized such that it is an integral number times the length along said discrete dimension of said third construction member.

56. The construction member of claim 53, further comprising a second box of construction members having a rectangular cross-section, said second box of construction members being slideably engageable with said first box of construction members by sliding said boxes relative to each other along said continuous dimension of said second construction member of said first box, with said engaging elements and receiving spaces of each engaging the corresponding structures of each other.

57. The construction member of claim 56, wherein said first and second rectangular boxes of construction members are slideably engageable along said continuous dimension of said second construction member of said first box with each other, such that any engaging element of said second box is engageable with any receiving space of said first construction member of said first box.

58. The construction member of claim 56, further comprising a separate support construction member having engaging elements and receiving spaces with substantially the same size and shape cross-section as said second construction member of said first box and substantially the same spatial relationships among said reference point, butt end and flush end of said construction element and said engaging elements, said reference point spaced along said discrete dimension relative to said butt and flush virtual corner lines such that if said first and second boxes are engaged with each other such that a continuous narrow end registering plane is formed from any construction member of said first box and any construction member of said second box, then said support construction member is slideably engageable simultaneously with both said construction members that form said narrow end registering plane, such that any engaging element of said support construction member is engageable with any receiving space of either of said construction members that form said continuous narrow end registering plane.

59. The construction member of claim 39, said engaging elements being located and said cross-sectional size and shape of each said engaging element and each said receiving space further being such that, if a fourth construction member, substantially identical with said first construction member, is joined, with said butt edge of said fourth construction member butt up against said obverse surface of said third construction member such that said flush edge of said third construction member is flush with said narrow end registering plane of said fourth construction member, then;

a. engaging elements of said fourth construction member are slidable along said sliding dimension of said first construction member into said receiving spaces of said first construction member;

b. a pair of said construction members that are joined by said engaging elements of said fourth construction member occupying said receiving spaces of said first construction member is secured against relative motion along said discrete dimension of said first construction member and along said meshing dimension of said first construction member; and c. any engaging element of said fourth construction member is engageable in the receiving space between any two engaging elements of said first construction member.

60. The construction member of claim 59, said engaging elements being located and cross-sectional size and shape of each said engaging element and each said receiving space further being such that:

a. if a fifth construction member, substantially identical with said first construction member, is joined:

i. with said butt end of said fifth construction member butt up against the obverse surface of said fourth construction member, such that said flush end of said fourth construction member is flush with said narrow end registering plane of said fifth construction member, and ii. with said butt end of said second construction member butt up against the obverse surface of said fifth construction member such that said flush end of said fifth construction member is flush with said narrow end registering plane of said second construction member;

b. then:

i. engaging elements of said fifth construction member are slidable along said sliding dimension of said first construction member into said receiving spaces of said first construction member;

ii. a pair of said construction members that are joined by said engaging elements of said fifth construction member occupying the receiving spaces of said first construction member is secured against relative motion along said discrete dimension of said first construction member and along said meshing dimension of said first construction element; and iii. any engaging element of said fifth construction member is engageable in the receiving space between any two engaging elements of said first construction member.

61. A first L-shaped construction unit, said L-shaped construction unit being oriented relative to a pair of first and second perpendicular boundary planes, that intersect and terminate at a "virtual corner line", said boundary planes defining a region therebetween, said L-shaped construction unit comprising:

a. a first arm portion that:

i. has a first narrow end registering plane, that is parallel to and spaced from said first boundary plane;

ii. extends along a first discrete dimension that extends perpendicular to said second boundary plane;

iii. extends along a sliding dimension, that is perpendicular to said first discrete dimension, and parallel to said virtual corner line;

iv. has a butt edge and a flush edge, spaced apart along said first discrete dimension, said flush edge being between said butt edge and said virtual corner line;

v. carried on said first arm portion, a plurality of first arm engaging elements, extending generally perpendicular to said narrow end registering plane;

A. each of said first arm engaging elements having:

I. a reference point that is identically located along said discrete dimension;

II. a butt edge and a flush edge, said butt edge of said engaging element lying between said butt edge of said first arm portion and said flush edge of said engaging element;

III. along said first discrete dimension, a substantially identical cross-section as cut by a cutting plane that is perpendicular to said base plane and parallel to said first discrete dimension, said cross section having:

(α). attached directly to said arm portion, a central root portion that is attached across its entire width extent along said first discrete dimension;

(β). a butt ear portion that is directly attached to said root portion and is free from direct attachment to said arm portion;

(γ). a flush ear portion that is directly attached to said root portion and is free from direct attachment to said arm portion; and (δ). a meshing height, as measured from and perpendicular to said first narrow end registering plane, to a first wide end registering plane, extending such that said first boundary plane bisects said engaging element along its meshing height;

B. said engaging elements, being spaced equally, as measured between corresponding reference points on each of a successive pair of engaging elements, said spacing being defined as the "pitch," "p," of said engaging elements;

C. a receiving space formed between any pair of said engaging elements, having a crosssection, as cut by said cutting plane, that is substantially identical to the crosssection of any other receiving space between any other pair of said engaging elements;

D. said reference point of each of said engaging elements being spaced from said virtual corner line an integral number of pitches;

E. a "flush edge engaging region" lying between said flush edge of said first arm portion and said flush edge of a closest engaging element having a full representation of said cross-section, said flush edge engaging region having:

I. a non-zero length of said first arm portion; and

II. carried thereon, no greater than said root portion and said butt ear portion of an engaging element; and b. a second arm portion that:

i. has a second narrow end registering plane, that is parallel to and spaced from said second boundary plane;

ii. extends along a second discrete dimension that extends perpendicular to said first boundary plane;

iii. extends along said sliding dimension;

iv. has a butt edge and a flush edge spaced apart along said second discrete dimension, said butt edge being between said flush edge and said virtual corner line;

v. carried on said second arm portion, a plurality of second engaging elements, extending generally perpendicular to said second narrow end registering plane;

A. each of said second engaging elements having:

I. a reference point that is identically located along said second discrete dimension;

II. a butt edge and a flush edge, said butt edge of said second engaging element lying between said butt edge of said second arm portion and said flush edge of said second engaging element;

III. along said second discrete dimension, a substantially identical cross-section as cut by said cutting plane, said cross-section being substantially identical in size and shape to said cross-section of said engaging elements of said first arm portion; and IV. a meshing height, as measured from and perpendicular to said second narrow end registering plane to a second wide end registering plane, extending such that said second boundary plane bisects said second engaging element along its meshing height;

B. said pitch of said second arm engaging elements being equal to said pitch p of said first arm engaging elements;

C. a receiving space formed between any pair of said second engaging elements having a cross-section, as cut by said cutting plane, that is substantially identical to the cross-section of any other receiving space between any other pair of said first engaging elements and between any pair of said second engaging elements;

D. said reference point of each of said second engaging elements being spaced from said virtual corner line an integral number of pitches; and c. said cross-sectional size and shapes of each said engaging element and each said receiving space of both said first arm and said second arm being configured such that, a mating construction member, having an arm that is configured substantially identically to said first arm and carrying engaging elements that are shaped and sized and spaced substantially identically to those of said first arm engaging elements;

i. is slideably engageable along said sliding dimension, with said engaging elements of said first arm, being slidable into and occupying said receiving spaces of said first arm;

ii. is, if joined to said first arm portion by said engaging elements of said mating construction member occupying said receiving spaces of said first arm portion, secured against relative motion along said first discrete dimension of said first arm portion and along a first meshing dimension that is perpendicular to said first boundary plane;

iii. is engageable with said first arm portion by any engaging element of said mating construction member occupying any receiving space of said first arm portion;

iv. is also slideably engageable along said continuous dimension, with said engaging elements of said second arm, being slidable into and occupying said receiving spaces of said second arm;

v. is, if joined to said second arm portion by said engaging elements of said mating construction member occupying said receiving spaces of said second arm portion, also secured against relative motion along said discrete dimension of said second arm portion and along a second mating dimension that is perpendicular to said second boundary plane; and vi. is engageable with said second arm portion by any engaging element of said mating construction member occupying any receiving space of said second arm portion.

* * * * *

UNITED STATES PATENT AND TRADEMARK OFFICE

CERTIFICATE OF CORRECTION

PATENT NO. : 5,775,046

DATED : July 7, 1998

INVENTOR(S) : Fanger et al.

It is certified that error appears in the above-identified patent and that said Letters Patent is hereby corrected as shown below:

Column 33, line 6, correction in text:

change "angle a" to --angle $\alpha$-- to read:

"at an angle $\alpha$ of approximately 120°"

Column 39, line 67, correction in text:

after "said" delete the comma "," to read:

"connected to said third construction member in the same manner"

Column 40, line 4, correction in text:

change "claims" to --claim-- to read:

"The construction member of claim 50, further comprising"

Column 40, line 9, correction in text:

change "claimed" to --claim-- to read:

"The construction member of claim 51, further comprising"

UNITED STATES PATENT AND TRADEMARK OFFICE

CERTIFICATE OF CORRECTION

PATENT NO. : 5,775,046

DATED : July 7, 1998

INVENTOR(S) : Fanger el al.

It is certified that error appears in the above-indentified patent and that said Letters Patent is hereby corrected as shown below:

Column 42, line 48, correction in text:

change "crosssection" to --cross-section-- to read:

"said engaging elements, having a cross-section,"

Signed and Sealed this

Third Day of November, 1998

*Attest:*

*Attesting Officer*

BRUCE LEHMAN

*Commissioner of Patents and Trademarks*